US008290411B2

(12) United States Patent
Ishii

(10) Patent No.: US 8,290,411 B2
(45) Date of Patent: Oct. 16, 2012

(54) IMAGE FORMING APPARATUS HAVING A PRE-TRANSFER NEUTRALIZING DEVICE TO REDUCE AN ELECTRIC POTENTIAL TO FACILITATE SEPARATION

(75) Inventor: Hirokazu Ishii, Kawasaki (JP)

(73) Assignee: Ricoh Company, Limited, Tokyo (JP)

( * ) Notice: Subject to any disclaimer, the term of this patent is extended or adjusted under 35 U.S.C. 154(b) by 473 days.

(21) Appl. No.: 12/497,164

(22) Filed: Jul. 2, 2009

(65) Prior Publication Data

US 2010/0008687 A1 Jan. 14, 2010

(30) Foreign Application Priority Data

Jul. 9, 2008 (JP) ..... 2008-179263
Mar. 27, 2009 (JP) ..... 2009-079786

(51) Int. Cl.
*G03G 15/16* (2006.01)

(52) U.S. Cl. ..... 399/296

(58) Field of Classification Search ..... 399/48, 399/66, 128, 296
See application file for complete search history.

(56) References Cited

U.S. PATENT DOCUMENTS

| | | | | |
|---|---|---|---|---|
| 5,515,146 | A | 5/1996 | Harasawa et al. | |
| 5,631,725 | A | 5/1997 | Harasawa et al. | |
| 5,812,919 | A | 9/1998 | Takano et al. | |
| 5,822,667 | A | 10/1998 | Hayama et al. | |
| 5,907,740 | A * | 5/1999 | Nozawa | 399/43 |
| 5,930,573 | A | 7/1999 | Miyamoto et al. | |
| 6,188,862 | B1 | 2/2001 | Ishii | |
| 6,282,386 | B1 | 8/2001 | Ishii | |
| 6,697,583 | B2 | 2/2004 | Ishii | |
| 6,778,802 | B2 | 8/2004 | Kabata et al. | |
| 7,184,678 | B2 | 2/2007 | Ishii et al. | |
| 7,373,100 | B2 * | 5/2008 | Hamada et al. | 399/296 |
| 7,409,182 | B2 | 8/2008 | Ishii | |
| 2007/0003333 | A1 | 1/2007 | Ishii | |
| 2007/0127941 | A1 | 6/2007 | Ishii et al. | |

FOREIGN PATENT DOCUMENTS

| | | | |
|---|---|---|---|
| JP | 58062663 | A * | 4/1983 |
| JP | 59015272 | A * | 1/1984 |
| JP | 10186814 | A * | 7/1998 |
| JP | 10-213974 | | 8/1998 |
| JP | 2002-268498 | | 9/2002 |
| JP | 2003021992 | A * | 1/2003 |
| JP | 2005-202351 | | 7/2005 |
| JP | 2006-259235 | | 9/2006 |

* cited by examiner

*Primary Examiner* — Robert Beatty
(74) *Attorney, Agent, or Firm* — Oblon, Spivak, McClelland, Maier & Neustadt, L.L.P.

(57) ABSTRACT

An image forming apparatus including a latent image bearing member, a charger to evenly charge a surface of the latent image bearing member, an electrostatic latent image forming device to form an electrostatic latent image on the surface of the latent image bearing member, a developing device to develop the electrostatic latent image into a toner image using toner, a transfer bias application device to apply a transfer bias to an image transfer area where the latent image bearing member faces a recording medium, a pre-transfer neutralizing device to reduce an electric potential at a portion on the surface of the latent image bearing member, a surface electric potential detector to detect an electric potential at the surface of the latent image bearing member, and a radiation amount control device to control an amount of radiation from the pre-transfer neutralizing device based on a detection result obtained by the surface electric potential detector.

7 Claims, 7 Drawing Sheets

IMAGE FORMING APPARATUS HAVING A PRE-TRANSFER NEUTRALIZING DEVICE TO REDUCE AN ELECTRIC POTENTIAL TO FACILITATE SEPARATION

CROSS-REFERENCE TO RELATED APPLICATIONS

The present patent application is based on and claims priority pursuant to 35 U.S.C. §119 from Japanese Patent Application Nos. 2008-179263, filed on Jul. 9, 2008 in the Japan Patent Office, and 2009-079786, filed on Mar. 27, 2009 in the Japan Patent Office, the entire contents of each of which are incorporated herein by reference.

BACKGROUND OF THE INVENTION

1. Field of the Invention

Exemplary aspects of the present invention generally relate to an image forming apparatus such as a copier, a facsimile machine, or a printer.

2. Description of the Background

Related-art image forming apparatuses, such as copiers, facsimile machines, printers, or multifunction devices having two or more of copying, printing, scanning, and facsimile functions, typically form a toner image on a recording medium (e.g., a sheet) according to image data using an electrophotographic method. In such a method, for example, a charger charges a surface of a latent image bearing member (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

To form images, the above-described image forming apparatuses may employ a negative-positive process. In the negative-positive process, the surface of the photoconductor is evenly charged by the charger, and then a potential at a portion on the evenly-charged surface of the photoconductor where an image is to be formed is reduced by electrostatic latent image forming means to form an electrostatic latent image on the surface of the photoconductor. Thereafter, toner charged to a polarity identical to a polarity of the charged surface of the photoconductor is applied to the electrostatic latent image using developing means to form a toner image. Alternatively, the image forming apparatuses may employ a positive-positive process to form images. In the positive-positive process, the surface of the photoconductor is evenly charged by the charger, and then a potential at a portion on the evenly-charged surface of the photoconductor where an image is not to be formed is reduced by the electrostatic latent image forming means to form an electrostatic latent image on the surface of the photoconductor. Thereafter, toner charged to a polarity opposite the polarity of the charged surface of the photoconductor is applied to the electrostatic latent image using the developing means to form a toner image.

When a recording medium electrostatically attracted to a recording medium conveyance member passes a transfer area facing the surface of the photoconductor, a transfer bias having a polarity that is the opposite of the polarity of the toner is supplied from transfer bias application means so that the toner image formed on the surface of the photoconductor by the negative-positive process or the positive-positive process is transferred onto the recording medium. Thereafter, the toner image is fixed to the recording medium by fixing means, and the recording medium having the fixed toner image thereon is discharged from the image forming apparatuses.

One longstanding problem of the above-described image forming apparatuses is the occurrence of paper jams when the recording medium passing through the transfer area is not removed from the surface of the photoconductor. Ordinarily, the recording medium passing through the transfer area is charged with the transfer bias, or dielectrically polarized, so that a front side of the recording medium having the toner image thereon has a polarity opposite the polarity of the surface of the photoconductor after passing through the transfer area. Accordingly, the recording medium passing through the transfer area is electrostatically attracted to the surface of the photoconductor passing through the transfer area at the same time as the recording medium, and is conveyed in a direction corresponding to a curvature of the photoconductor. At this time, because a resilience of the recording medium overcomes a force that electrostatically attracts the recording medium to the surface of the photoconductor, the recording medium is removed from the surface of the photoconductor and is appropriately conveyed to the fixing means and so forth.

However, when the force of electrostatic attraction is greater than the resilience of the recording medium, the recording medium is not removed from the surface of the photoconductor, causing a paper jam.

An example of several solutions for the above-described problem is provision of a separation pick on a downstream side from the transfer area relative to a direction of rotation of the surface of the photoconductor. A tip portion of the separation pick contacts the surface of the photoconductor, and accordingly, a leading edge of the recording medium electrostatically attracted to the surface of the photoconductor after passing through the transfer area is scratched by the tip portion of the separation pick. As a result, the recording medium is removed from the surface of the photoconductor and is conveyed to an appropriate conveyance path.

However, because the tip portion of the separation pick contacts the surface of the photoconductor, residual toner on the surface of the photoconductor gets attached to the tip portion of the separation pick. Consequently, when the recording medium is removed from the surface of the photoconductor using the separation pick, the residual toner attached to the tip portion of the separation pick gets further attached to the leading edge of the recording medium, causing blurring at the leading edge of the recording medium, or unnecessary lines on the image formed on the recording medium. Further, when being removed by the tip portion of the separation pick, a rear edge of the recording medium rapidly moves toward the recording medium conveyance member due to a loss of the force that electrostatically attracts the recording medium to the surface of the photoconductor. Consequently, the toner attached to the rear edge of the recording medium is scattered, blurring the image formed at the rear edge of the recording medium. In particular, image blur tends to occur at the rear edges of A3-size recording media.

Further, when the separation pick is deformed or abraded, it is difficult to remove the recording medium from the surface of the photoconductor using the separation pick. Consequently, a paper jam may occur at the separation pick, or the recording medium electrostatically attracted to the surface of the photoconductor may pass the separation pick and inadvertently conveyed to a cleaning device.

One approach to solve the above-described problems is to increase a surface resistivity of the recording medium conveyance member to $10^8\Omega/\square$ or greater. Accordingly, a larger amount of charge can be retained on a surface layer of the recording medium conveyance member, so that a force that electrostatically attracts the recording medium to the recording medium conveyance member becomes greater than the force that electrostatically attracts the recording medium to the surface of the photoconductor. As a result, because the recording medium is electrostatically attracted and conveyed by the recording medium conveyance member, the separation pick is not necessary for removing the recording medium from the surface of the photoconductor, preventing the above-described problems caused by use of the separation pick.

However, upon close examination by the inventors of the present invention, it has been discovered that in the case of image forming apparatuses in which scumming caused by attachment of toner to a portion of the surface of the photoconductor where an image is not to be formed rarely occurs, an increase in the surface resistivity of the recording medium conveyance member by itself is not effective for removing the recording medium from the surface of the photoconductor. The toner attached to such portion of the surface of the photoconductor prevents the recording medium from being electrostatically attracted to the surface of the photoconductor in image forming apparatuses in which scumming often occurs on the surface of the photoconductor. As a result, the recording medium is attracted to the recording medium conveyance member by the charges on the surface layer of the recording medium conveyance member. By contrast, in image forming apparatuses in which scumming rarely occurs on the surface of the photoconductor, the force that electrostatically attracts the recording medium to the surface of the photoconductor tends to be too large. Consequently, the charges on the surface layer of the recording medium conveyance member cannot cause the recording medium to be attracted to the recording medium conveyance member, and the recording medium is not removed from the surface of the photoconductor.

Another approach to remove the recording medium from the surface of the photoconductor is to provide a pre-transfer irradiating device (pre-transfer neutralizing means) in the image forming apparatuses. The pre-transfer irradiating device reduces the electric potential at all portions on the surface of the photoconductor that are to face the recording medium at the transfer area, so that such portions on the surface of the photoconductor are neutralized after development is performed by the developing means and before the toner image is transferred onto the recording medium at the transfer area. Because the potential at such portions is neutralized by the pre-transfer irradiating device in advance before transfer, the force that electrostatically attracts the recording medium to the surface of the photoconductor after the recording medium passes through the transfer area may be reduced. As a result, the ability to remove the recording medium passing through the transfer area from the surface of the photoconductor (hereinafter simply referred to as removability of a recording medium) is enhanced, preventing the above-described problems.

However, because all portions on the surface of the photoconductor that are to face the recording medium at the transfer area are neutralized by the pre-transfer irradiating device, light-induced fatigue of the photoconductor is accelerated, thus shortening the service life of the photoconductor.

Further, in the negative-positive process, movement of the toner attached to the electrostatic latent image formed on the surface of the photoconductor in a direction along the surface of the photoconductor is restricted by a magnetic field generated between the electrostatic latent image and a portion other than the electrostatic latent image charged to a polarity identical to the polarity of the toner. However, because all portions on the surface of the photoconductor that are to face the recording medium at the transfer area are neutralized, the potential at portions other than the electrostatic latent image adjacent to the electrostatic latent image is evenly decreased. Consequently, the magnetic field between the electrostatic latent image and the portion other than the electrostatic latent image is decreased, and a repulsive force between toner having the same polarity is increased. As a result, the toner is scattered on the surface of the photoconductor before transfer, causing image deterioration including blur.

To solve the above-described problems, an image forming apparatus in which electrostatic attraction of only a portion on the surface of the photoconductor corresponding to the leading edge of the recording medium is decreased has been proposed to achieve enhanced removability of the recording medium from the surface of the photoconductor. Specifically, only the portion on the surface of the photoconductor corresponding to an area between the leading edge of the recording medium and 2 or 3 mm ahead of the leading edge (hereinafter referred to as a leading edge area) is neutralized. Accordingly, the potential at portions other than the electrostatic latent image on the surface of the photoconductor corresponding to the leading edge area of the recording medium is reduced by neutralization, decreasing the force that electrostatically attracts the leading edge area of the recording medium to the surface of the photoconductor. As a result, the leading edge of the recording medium is removed from the surface of the photoconductor, and a paper jam can be prevented even when a recording medium having a higher resilience is used. Further, because the portion to be neutralized by the pre-transfer irradiating device can be reduced as described above, light-induced fatigue of the photoconductor is suppressed, preventing acceleration of deterioration of the photoconductor.

It is to be noted that when the negative-positive process is employed in the above-described image forming apparatus, a potential at portions other than the electrostatic latent image on the surface of the photoconductor corresponding to portions other than the leading edge area of the recording medium, that is, almost all portions of the recording medium, is not reduced. As a result, the toner attached to the electrostatic latent image formed at portions on the surface of the photoconductor corresponding to portions other than the leading edge area of the recording medium is not scattered. In other words, toner scattering can be prevented at portions on the surface of the photoconductor corresponding to almost all portions of the recording medium, preventing image deterioration.

Further, in the above-described image forming apparatus, a transfer bias is decreased only when the portion on the surface of the photoconductor corresponding to the leading edge area of the recording medium is positioned at the transfer area compared to a transfer bias applied when portions on the surface of the photoconductor corresponding to portions other than the leading edge area of the recording medium are positioned at the transfer area. Accordingly, an amount of charge supplied to the leading edge area of the recording medium is reduced or eliminated, and the force that electrostatically attracts the leading edge of the recording medium to the surface of the photoconductor is further reduced. As a result, even a recording medium having a lower resilience can be reliably removed from the surface of the photoconductor.

However, it has been confirmed by the inventors of the present invention that the removability of the recording medium from the surface of the photoconductor cannot be reliably provided over time using the approaches described above. Upon close inspection, it has been found that the potential at the surface of the photoconductor cannot be sufficiently reduced by neutralization due to deterioration of the photoconductor over time. Specifically, when the potential at the surface of the photoconductor cannot be sufficiently reduced, the portion on the surface of the photoconductor corresponding to the leading edge area of the recording medium cannot be sufficiently neutralized by the pre-transfer irradiating device over time. In a widely-used image forming apparatus, when the potential at the surface of the photoconductor cannot be sufficiently reduced by neutralization, the potential at the surface of the photoconductor is increased by performing image adjustment such as process control to provide higher-quality images. Consequently, the potential at the portion on the surface of the photoconductor corresponding to the leading edge area of the recording medium cannot be sufficiently neutralized by the pre-transfer irradiating device. As a result, the leading edge of the recording medium tends not to be removed from the surface of the photoconductor.

One possible solution to the above-described problem is to increase an amount of light to be directed onto the surface of the photoconductor from the pre-transfer irradiating device (hereinafter referred to as an amount of radiation) so that the potential at the surface of the photoconductor can be sufficiently reduced even when the photoconductor deteriorates over time.

However, use of too great amount of radiation from an initial stage of use of the photoconductor accelerates deterioration of the photoconductor. Further, formation of images at the leading edge area of the recording medium has come to be demanded of image forming apparatuses, and when the amount of radiation is increased at the initial stage, deterioration of the photoconductor is accelerated. In image forming apparatuses employing the negative-positive process, the portion on the surface of the photoconductor corresponding to the leading edge area of the recording medium is over-neutralized. Consequently, toner scattering easily occurs when the image is formed at the leading edge area of the recording medium, possibly causing blurring of the image formed at the leading edge area of the recording medium.

In the above-described case in which the transfer bias is decreased when the portion on the surface of the photoconductor corresponding to the leading edge area of the recording medium is positioned at the transfer area (hereinafter referred to as a leading edge transfer bias) to provide reliable removability of the recording medium from the surface of the photoconductor, the potential at the surface of the photoconductor cannot be sufficiently reduced by neutralization due to deterioration of the photoconductor. Consequently, the potential at the surface of the photoconductor is increased by performing process control, preventing reliable removability of the recording medium from the surface of the photoconductor.

One possible way to provide reliable removability of the recording medium from the surface of the photoconductor even when the potential at the surface of the photoconductor is increased over time is to decrease the leading edge transfer bias. However, when the leading edge transfer bias is too low, the toner image formed at the leading edge area of the recording medium cannot be satisfactorily transferred onto the recording medium at the initial stage of use of the photoconductor.

SUMMARY

In view of the foregoing, illustrative embodiments of the present invention provide an image forming apparatus capable of reliably removing a recording medium from a surface of a photoconductor over time. In the above-describe image forming apparatus, a portion affected by toner scattering or irregular transfer can be reduced even when an image is formed at a leading edge area of the recording medium.

In one illustrative embodiment, an image forming apparatus includes a latent image bearing member, rotated to bear an electrostatic latent image on a surface thereof, a charger to evenly charge the surface of the latent image bearing member, an electrostatic latent image forming device to form an electrostatic latent image on the surface of the latent image bearing member, a developing device to develop the electrostatic latent image formed on the surface of the latent image bearing member into a toner image using toner, a transfer bias application device to apply a transfer bias to an image transfer area where the latent image bearing member faces a recording medium onto which the toner image is to be transferred from the surface of the latent image bearing member, a pre-transfer neutralizing device to reduce an electric potential at a portion on the surface of the latent image bearing member that is to face a leading edge area of the recording medium at the image transfer area after development performed by the developing device, a surface electric potential detector to detect an electric potential at the surface of the latent image bearing member, and a radiation amount control device to control an amount of radiation from the pre-transfer neutralizing device based on a detection result obtained by the surface electric potential detector.

Another illustrative embodiment provides an image forming apparatus including a latent image bearing member, rotated to bear an electrostatic latent image on a surface thereof, a charger to evenly charge the surface of the latent image bearing member, an electrostatic latent image forming device to form an electrostatic latent image on the surface of the latent image bearing member, a developing device to develop the electrostatic latent image formed on the surface of the latent image bearing member into a toner image using toner, a transfer bias application device to apply a transfer bias to an image transfer area where the latent image bearing member faces a recording medium onto which the toner image is to be transferred from the surface of the latent image bearing member, a control unit to control the transfer bias application device to supply a leading edge transfer bias to the image transfer area before a leading edge of the recording medium enters the image transfer area, and then supply a normal transfer bias higher than the leading edge transfer bias to the image transfer area before a rear end of a leading edge area of the recording medium enters the image transfer area, and a surface electric potential detector to detect an electric potential at the surface of the latent image bearing member. The control unit controls the leading edge transfer bias based on a detection result obtained by the surface electric potential detector.

Additional features and advantages of the present invention will be more fully apparent from the following detailed description of illustrative embodiments, the accompanying drawings, and the associated claims.

BRIEF DESCRIPTION OF THE DRAWINGS

A more complete appreciation of the disclosure and many of the attendant advantages thereof will be more readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
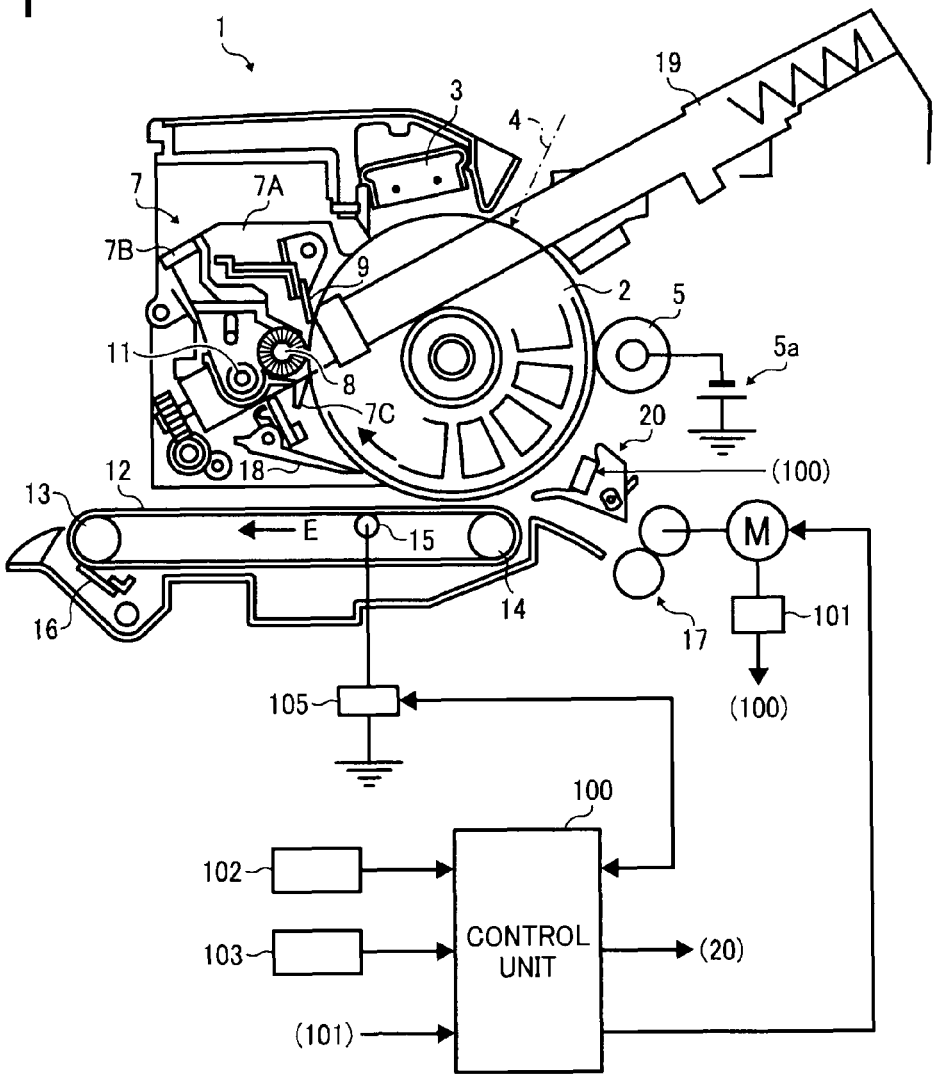
FIG. 1 is a schematic view illustrating an example of a configuration of an image forming apparatus according to illustrative embodiments.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Illustrative embodiments of the present invention are now described below with reference to the accompanying drawings.

In a later-described comparative example, illustrative embodiment, and exemplary variation, for the sake of simplicity the same reference numerals will be given to identical constituent elements such as parts and materials having the same functions, and redundant descriptions thereof omitted unless otherwise required.

FIG. 1 is a schematic view illustrating an example of a configuration of a printer serving as an image forming apparatus 1 according to illustrative embodiments. The image forming apparatus 1 is a monochrome image forming apparatus employing electrophotography, and performs negative-positive development using a direct transfer method. The image forming apparatus 1 includes a single photoconductor 2 serving as a latent image bearing member. It is to be noted that illustrative embodiments are applicable to a tandem type full-color image forming apparatus including, for example, four photoconductors each serving as a latent image bearing member, as long as the tandem type full-color image forming apparatus employs electrophotography and performs negative-positive development using the direct transfer method.

The photoconductor 2 may include an amorphous silicone photoconductor (hereinafter referred to as an "a-Si photoconductor"). A conductive support is heated to from 50° C. to 400° C., and a photoconductive layer including an amorphous silicone (hereinafter referred to as an "a-Si") is formed on the conductive support by using a film formation method such as a vacuum evaporation method, a spattering method, an ion plating method, a thermal CVD method, an optical CVD method, and a plasma CVD method. Among the above-described examples, the plasma CVD method, in which a gas is decomposed by a direct-current, or a high-frequency glow discharge or a microwave glow discharge to form an a-Si sedimentary film on the conductive support, is preferably used. Although being set to 100 mm according to illustrative embodiments, a diameter of the photoconductor 2 is not limited to such a value. Particularly, the photoconductor 2 having a diameter smaller than 100 mm, for example, a diameter of 80 mm, provides higher removability of a recording sheet from a surface of the photoconductor 2.

A charger 3 is provided around the photoconductor 2 to evenly charge the surface of the photoconductor 2. Specifically, the charger 3 evenly charges the surface of the photoconductor 2 to a predetermined negative potential. Although a contactless charger is used as the charger 3 according to illustrative embodiments, the surface of the photoconductor 2 may be evenly charged by being contacted with a charging roller rotating along with rotation of the surface of the photoconductor 2.

An irradiating device, not shown, serving as electrostatic latent image forming means is provided above the photoconductor 2. The irradiating device directs light 4 onto the surface of the photoconductor 2 based on image data. As a result, the potential at a portion on the surface of the photoconductor 2 where an image is to be formed is reduced to form an electrostatic latent image on the surface of the photoconductor. An example of the irradiating device includes a laser beam scanner using a laser diode.

A developing device serving as developing means to develop the electrostatic latent image formed on the surface of the photoconductor 2 is provided around the photoconductor 2. In illustrative embodiments, a two-component non-magnetic contact developing method is employed using a two-component developer including toner charged to a polarity identical to the polarity on the charged surface of the photoconductor 2, that is, a negative polarity. Specifically, the developing device includes a developing roller 5 serving as a developer bearing member. A predetermined developing bias is applied from a high-voltage power supply 5*a* to the developing roller 5, so that the toner included in the developer borne on the developing roller 5 is moved to the electrostatic latent image formed on the surface of the photoconductor 2. Accordingly, the toner is attached to the electrostatic latent image, and a toner image corresponding to the electrostatic latent image is formed on the surface of the photoconductor 2.

A conveyance belt unit is provided below the photoconductor 2. The conveyance belt unit includes a conveyance belt 12 serving as a recording medium conveyance member. The conveyance belt 12 is stretched between a two support rollers 13 and 14. The conveyance belt 12 contacts the photoconductor 2 at a position where the conveyance belt 12 and the photoconductor 2 face each other to form a transfer nip. The conveyance belt 12 is rotated in a direction indicated by an arrow E in FIG. 1, and a recording sheet conveyed from a pair of registration rollers 17 is electrostatically attracted to a surface of the conveyance belt 12. The conveyance belt 12 conveys the recording sheet such that the recording sheet passes through the transfer nip. A transfer roller 15 serving as transfer bias application means connected to a constant current control power supply circuit 105 contacts a back surface of the conveyance belt 12 at a portion near a downstream side from the transfer nip relative to a direction of conveyance of the recording sheet. When a transfer bias is applied to the transfer roller 15, a transfer current is supplied to the transfer nip through the conveyance belt 12. Accordingly, the toner image formed on the surface of the photoconductor 2 is transferred onto the recording sheet. The conveyance belt unit further includes a belt cleaning blade 16 serving as a cleaning member to remove adhered substances such as residual toner from the surface of the conveyance belt 12.

In place of the transfer roller 15, a transfer charger may be used as the transfer bias application means.

Figure 2:
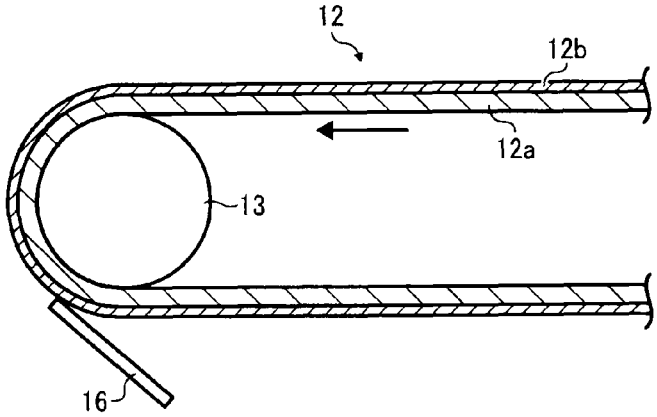
FIG. 2 is a cross-sectional view illustrating a conveyance belt provided in the image forming apparatus.

FIG. 2 is a cross-sectional view illustrating the conveyance belt 12. The conveyance belt 12 includes a double-layered looped belt in which a base layer 12*a* is coated with a surface covering layer 12*b*. It is to be noted that the conveyance belt 12 may include a single-layered looped belt, or a looped belt having layers more than two layers.

The conveyance belt 12 preferably has a volume resistivity of from $1\times10^{8}$ to $1\times10^{11}$ Ω·cm, a surface resistivity of the surface covering layer 12*b* of from $1\times10^{8}$ to $1\times10^{12}$Ω·□, and a surface resistivity of the base layer 12*a* of from $1\times10^{8}$ to $1\times10^{11}$Ω·□. It is to be noted that the above-described values of the volume resistivity and the surface resistivity are measured according to a method based on JIS K 6911, by applying a voltage of 100V. Alternatively, in order to enhance a removability of the recording sheet from the conveyance belt 12, the conveyance belt 12 may preferably include a thicker surface covering layer having a surface resistivity of up to $1\times10^{14}$Ω·□.

The above-described examples are preferably used in illustrative embodiments. Alternatively, a low-resistance conveyance belt having a volume resistivity of from $1\times10^{5}$ to $1\times10^{6}$ Ω·cm, or a high-resistance conveyance belt having a volume resistivity greater than $1\times10^{14}$ Ω·cm may be used as the conveyance belt 12.

The base layer 12*a* generally includes a material for maintaining a strength of the conveyance belt 12, and is usually formed thicker than the surface covering layer 12*b*. The base layer 12*a* preferably includes an elastic belt so that the base layer 12*a* is appropriately stretchable. Further, the conveyance belt 12 may preferably include materials in which the resistivity of the conveyance belt 12 is hardly influenced over time or by environmental changes. Preferable examples of materials included in the base layer 12*a* include a rubber such as a chloroprene rubber, an EPDM rubber, and a silicone rubber, or a mixture thereof. A conductivity agent such as a carbon and zinc oxides may be added to the rubber in accordance with the necessity in order to control the resistivity. Alternatively, an ionic material may be dispersed into the rubber to control the resistivity. Further alternatively, a mixture of the conductivity agent and the ionic material with a predetermined proportion may be added to the rubber. A resin belt including PVDF or PI may be used as the base layer 12*a*.

The surface covering layer 12*b* is formed on the base layer 12*a* in order to maintain high cleaning performance. The surface of the conveyance belt 12 is cleaned using the belt cleaning blade 16. Consequently, the surface of the conveyance belt 12 is curled up due to an increase in a scraping resistance (μ) under a higher temperature and humidity environment over time, causing deterioration in cleaning performance. In order to prevent abrasion of the conveyance belt 12, the surface covering layer 12*b* is formed of a material having a lower scraping resistance so that higher cleaning performance can be maintained. Further, a material having elasticity corresponding to the elasticity of the base layer 12*a* is essential for the surface covering layer 12*b* in order to maintain higher cleaning performance.

As described above, a material having a lower scraping resistance and higher elasticity is required for the surface covering layer 12*b*, and fluorocarbon resins such as polyvinylidene fluoride and ethylene tetrafluoride are preferably used as such a material. Specifically, Emralon 345 manufactured by Henkel Technologies Japan, Ltd. is used as a main resin included in the surface covering layer 12*b*. The Emralon 345 is slightly modified to form an embrocation to be applied to the base layer 12*a* as the surface covering layer 12*b*. The surface resistivity of the surface covering layer 12*b* is set within a range from $1\times10^{8}$ to $1\times10^{12}$Ω·□ as described above in order to maintain the ability to convey the recording sheet, that is, the ability to electrostatically attract the recording sheet to the surface of the conveyance belt 12. A thickness of the surface covering layer 12*b* is set within a range from several μm to 10 μm so that the surface resistivity of the surface covering layer 12*b* is maintained within the above-described range.

Referring back to FIG. 1, a cleaning device 7 serving as cleaning means to remove residual toner from the surface of the photoconductor 2 after the toner image is transferred onto the recording sheet is provided around the photoconductor 2. The cleaning device 7 includes a cleaning unit 7A having an opening facing the photoconductor 2. The cleaning unit 7A includes a cleaning brush 8 contacting the surface of the photoconductor 2. In addition, in the cleaning unit 7A, an urethane cleaning blade 9 contacting the surface of the photoconductor 2 is provided on a downstream side from the cleaning brush 8 relative to a direction of rotation of the surface of the photoconductor 2. The cleaning unit 7A further includes a collection coil 11 to convey the toner collected from the surface of the photoconductor 2 to a conveyance pipe 19, so that the toner is reused. Further, a seal 7C provided on an upstream side from the opening of the cleaning unit 7A relative to the direction of rotation of the surface of the photoconductor 2 to seal an edge of the opening, and a pressure release unit 7B to release a pressure in the cleaning unit 7A are included in the cleaning unit 7A.

A separation pick 18 is also provided around the photoconductor 2 so that a leading edge of the recording sheet is removed from the surface of the photoconductor 2 even when the leading edge of the recording sheet is electrostatically attracted to the surface of the photoconductor 2 after passing through the transfer nip. The separation pick 18 is provided on a downstream side from the transfer nip relative to the direction of rotation of the surface of the photoconductor 2, and a tip portion of the separation pick 18 contacts the surface of the photoconductor 2. Although it is to be described in detail later, the leading edge of the recording sheet is usually removed from the surface of the photoconductor 2 before reaching the separation pick 18 according to illustrative embodiments. Therefore, the separation pick 18 is provided as ultimate means to remove the recording sheet from the surface of the photoconductor 2.

Further, a pre-transfer lamp (PTL) 20 serving as pre-transfer neutralizing means is provided around the photoconductor 2. The PTL 20 reduces a potential at a portion other than the electrostatic latent image formed on the surface of the photoconductor 2 that is to face a leading edge area of the recording sheet at the transfer nip after development. The PTL 20 is provided at a position facing the surface of the photoconductor 2 between the developing device and the transfer nip. In illustrative embodiments, an amount of radiation from the PTL 20 is set such that the potential at the portion other than the electrostatic latent image on the surface of the photoconductor 2 is reduced to −250 V or less.

As illustrated in FIG. 1, the image forming apparatus 1 further includes a control unit 100 serving as control means. The control unit 100 is connected to a start sensor 101 that detects a startup status of a registration motor M for driving the pair of registration rollers 17. The control unit 100 receives a signal from the start sensor 101 to obtain a time to start conveyance of the recording sheet to the transfer nip. Further, the control unit 100 is connected to each of an operation panel 102 in which an image forming mode and a size of the recording sheet are selected, and an environment detection sensor 103 that detects a temperature and a humidity inside the image forming apparatus 1. The control unit 100 also receives a signal from each of the operation panel 102 and the environment detection sensor 103. The control unit 100 is further connected to the constant current control power supply circuit 105 to set a control current value Id of the constant current control power supply circuit 105, detect an output voltage of the constant current control power supply circuit 105, and switch a transfer bias. The control unit 100 is further connected to the registration motor M to control a time when the pair of registration rollers 17 starts to convey the recording sheet to the transfer nip. The control unit 100 is further connected to the PTL 20 to control a time when the PTL 20 starts or stops irradiation and the amount of radiation from the PTL 20. The control unit 100 determines requirements for image formation such as a charging bias, a developing bias, and an amount of radiation so that images are preferably formed when the image forming apparatus 1 is turned on.

Figure 3:
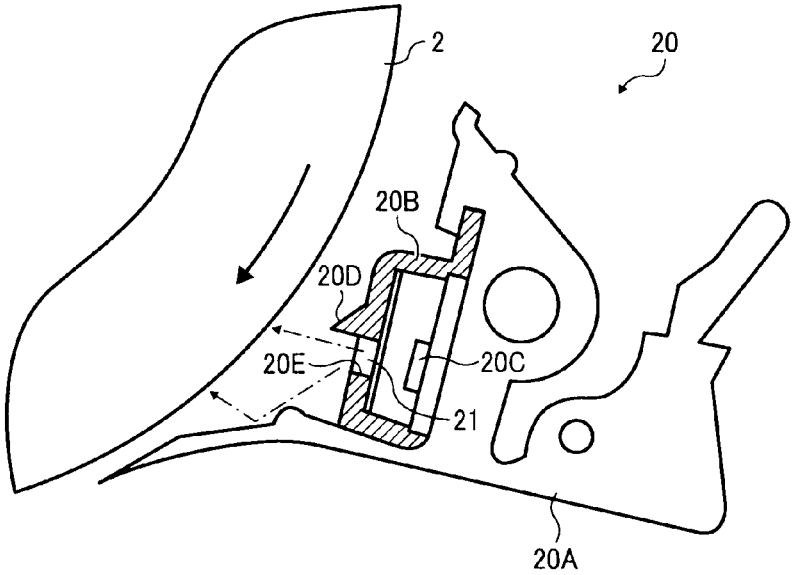
FIG. 3 is a schematic view illustrating a configuration of a PTL provided in the image forming apparatus.

FIG. 3 is a schematic view illustrating a configuration of the PTL 20.

The PTL 20 includes a recording sheet guide member 20A to guide the recording sheet to the transfer nip. The recording sheet guide member 20A includes a material having a higher optical reflectivity such as an aluminum. The PTL 20 further includes a cover member 20B including a heat-resistance material provided in the recording sheet guide member 20A, and a pre-transfer irradiating member 20C including an LED array arranged in the cover member 20B.

An opening 20E is formed on the cover member 20B at a position facing the photoconductor 2, so that light is directed to the photoconductor 2 from the pre-transfer irradiating member 20C provided within the PTL 20.

A portion on the cover member 20B from where the light emitted from the pre-transfer irradiating member 20C is directed to the photoconductor 2, that is, the opening 20E, is provided with a dustproof member 21. A canopy 20D for preventing a light leakage to the developing device is provided on an edge of the opening 20E on the developing device side. The dustproof member 21 is formed with a film including a transparent resin, a glass material, or the like having a light transmittance of 50% or greater. The dust proof member 21 prevents foreign substances such as the toner and a paper dust from entering into the cover member 20B from the photoconductor 2 side.

The PTL 20 having the above-described configuration includes the pre-transfer irradiating member 20C in the recording sheet guide member 20A having a higher optical reflectivity. Accordingly, pre-transfer irradiation can be reliably performed at a position closest to the surface of the photoconductor 2 without disturbing conveyance of the recording sheet. Particularly, the recording sheet guide member 20A is provided so that a predetermined distance from the photoconductor 2 can be precisely maintained. Further, an amount of radiation necessary for keeping the potential at the surface of the photoconductor 2 at −200 V or less is reliably obtained to prevent the leading edge of the recording sheet from attaching to the surface of the photoconductor 2.

Although the pre-transfer irradiating member 20C includes the LED array according to illustrative embodiments, alternatively, the pre-transfer irradiating member 20C may include a single LED and a polygon scanner including a polygon mirror and a polygon motor, so that the surface of the photoconductor 2 is neutralized in the same manner as the irradiating device, not shown, serving as the electrostatic latent image forming means. In a case in which multiple irradiating devices are provided around the photoconductor 2 in the same manner as a full-color image forming apparatus in which multiple units each including a charger, an irradiating device, and a developing device are provided around a single photoconductor, one of the multiple irradiating devices may function as the PTL 20 to neutralize the potential at the surface of the photoconductor 2.

According to illustrative embodiments, the PTL 20 neutralizes only a portion on the surface of the photoconductor 2 that is to face the leading edge area of the recording sheet at the transfer nip.

When all portions on the surface of the photoconductor 2 that are to face the recording sheet at the transfer nip are neutralized, a potential at an unexposed portion adjacent to the toner image is also decreased. Consequently, a force that attracts the toner to an exposed portion on the surface of the photoconductor 2 is also decreased. As a result, the toner having the same polarity repels and is scattered on the surface of the photoconductor 2 before being transferred onto the recording sheet, causing image deterioration including blur.

When the leading edge of the recording sheet is removed from the surface of the photoconductor 2, a portion other than the leading edge of the recording sheet is also removed from the surface of the photoconductor 2, preventing a paper jam. Therefore, according to illustrative embodiments, only the portion on the surface of the photoconductor 2 that is to face the leading edge area of the recording sheet at the transfer nip is neutralized to reduce the influence on the image quality and to preferably remove the recording sheet from the surface of the photoconductor 2.

A description is now given of how to control irradiation performed by the PTL 20.

According to illustrative embodiments, irradiation by the PTL 20 is started using a drive-on signal from the registration motor M as a trigger. For example, when a process linear velocity is 362 mm/sec, the control unit 100 turns on the LED array (included in the pre-transfer irradiating member 20C of the PTL 20) at the same time as it receives the drive-on signal from the registration motor M to neutralize the surface of the photoconductor 2. The control unit 100 turns the LED array off 108.4 msec after the start of irradiation. When the process linear velocity is 270 mm/sec, the control unit 100 turns the LED array off 139.3 msec after the start of irradiation. Instead of turning on the LED array in the PTL 20 at the same time when the control unit 100 receives the drive-on signal from the registration motor M, the LED array in the PTL 20 may be turned on a predetermined period of time after the start of driving of the registration motor M. Alternatively, the start of irradiation by the PTL 20 may be controlled based on a writing signal to the irradiating device, not shown.

There is a trade-off between occurrence of irregular images including blur caused by a time to stop irradiation by the PTL 20 and a usage rate of the separation pick 18 to remove the leading edge of the recording sheet from the surface of the photoconductor 2. Specifically, when the LED array in the PTL 20 is turned off too early, the ability to prevent occurrence of irregular images including blur is increased. However, the removability of the leading edge of the recording sheet from the surface of the photoconductor 2 is reduced. As a result, the usage rate of the separation pick 18 to remove the recording sheet from the surface of the photoconductor 2 is increased. By contrast, when the LED array in the PTL 20 is turned off too late, the removability of the leading edge of the recording sheet from the surface of the photoconductor 2 is increased, so that the usage rate of the separation pick 18 is reduced. However, occurrence of irregular images including blur is increased. Therefore, the time to turn off the LED array in the PTL 20 is required to be set such that both occurrence of irregular images and the usage rate of the separation pick 18 to remove the recording sheet from the surface of the photoconductor 2 are reduced. Because a configuration varies for each image forming apparatus, the time to turn off the LED array in the PTL 20 may be appropriately set for each image forming apparatus. Further, the time to turn off the LED array in the PTL 20 may be changed when an image is formed on a front side of the recording sheet and when an image is formed on a back side of the recording sheet.

According to the illustrative embodiments, a transfer bias applied to the recording sheet when the leading edge area passes through the transfer nip (hereinafter referred to as a leading edge transfer bias) is set lower than a normal transfer bias. Accordingly, an amount of charge at the leading edge area of the recording sheet is reduced or eliminated, and electrostatic attraction at the leading edge area of the recording sheet to the surface of the photoconductor 2 is further decreased. As a result, the recording sheet is reliably removed from the surface of the photoconductor 2 before reaching the separation pick 18.

A description is now given of how to control the transfer bias.

According to illustrative embodiments, the leading edge transfer bias is applied to the transfer roller 15 during a time between when the leading edge of the recording sheet enters the transfer nip and when the leading edge of the recording sheet reaches a center of the transfer nip. When the leading edge of the recording sheet reaches the center of the transfer nip, the normal transfer bias is applied to the transfer roller 15.

The drive-on signal from the registration motor M is used as a trigger to switch application of the transfer bias from the leading edge transfer bias to the normal transfer bias. For example, in a case in which a width of the transfer nip is 8 mm, a distance from the pair of registration rollers 17 to the transfer nip is 61 mm, and the process linear velocity is 362 mm/sec, the transfer bias applied to the transfer roller 15 is switched from the leading edge transfer bias to the normal transfer bias 183 msec after the start of driving of the registration motor M. Accordingly, the transfer bias applied to the transfer roller 15 is switched from the leading edge transfer bias to the normal transfer bias when the leading edge of the recording sheet reaches the center of the transfer nip, that is, a position 4 mm ahead of an entrance of the transfer nip. It is to be noted that a time to start application of the leading edge transfer bias to the transfer roller 15 is the same as that in widely-used image forming apparatuses.

According to illustrative embodiments, the leading edge transfer bias is set to 15 μA. When the process linear velocity is 362 mm/sec, the normal transfer bias is set to 65 μA, and when the process linear velocity is 270 mm/sec, the normal transfer bias is set to 50 μA. As long as the leading edge transfer bias is 15 μA or less, the recording sheet can be preferably removed from the surface of the photoconductor 2 without using the separation pick 18. It is to be noted that each of the leading edge transfer bias and the normal transfer bias is a current ($I_{out}$) flowing into the photoconductor 2. Specifically, the control current value Id of the constant current control power supply circuit 105 is controlled such that the current flowing into the photoconductor 2 becomes the leading edge transfer bias and the normal transfer bias.

A charge density of the normal transfer bias is represented by the following expression of charge density of transfer bias=$I_{out}/(V \cdot LR)$, where $I_{out}$ is the current flowing into the photoconductor 2, that is, the leading edge transfer bias; V is a linear velocity of the conveyance belt 12, that is, the process linear velocity; and LR is a width of the transfer roller 15 in a main scanning direction.

In a case in which V is 362 mm/sec and LR is 310 mm, the recording sheet is removed from the surface of the photoconductor 2 without using the separation pick 18 as long as the charging density of the leading edge transfer bias is $2.0 \times 10^{-8}$ c/cm$^2$ or less.

Figure 4:
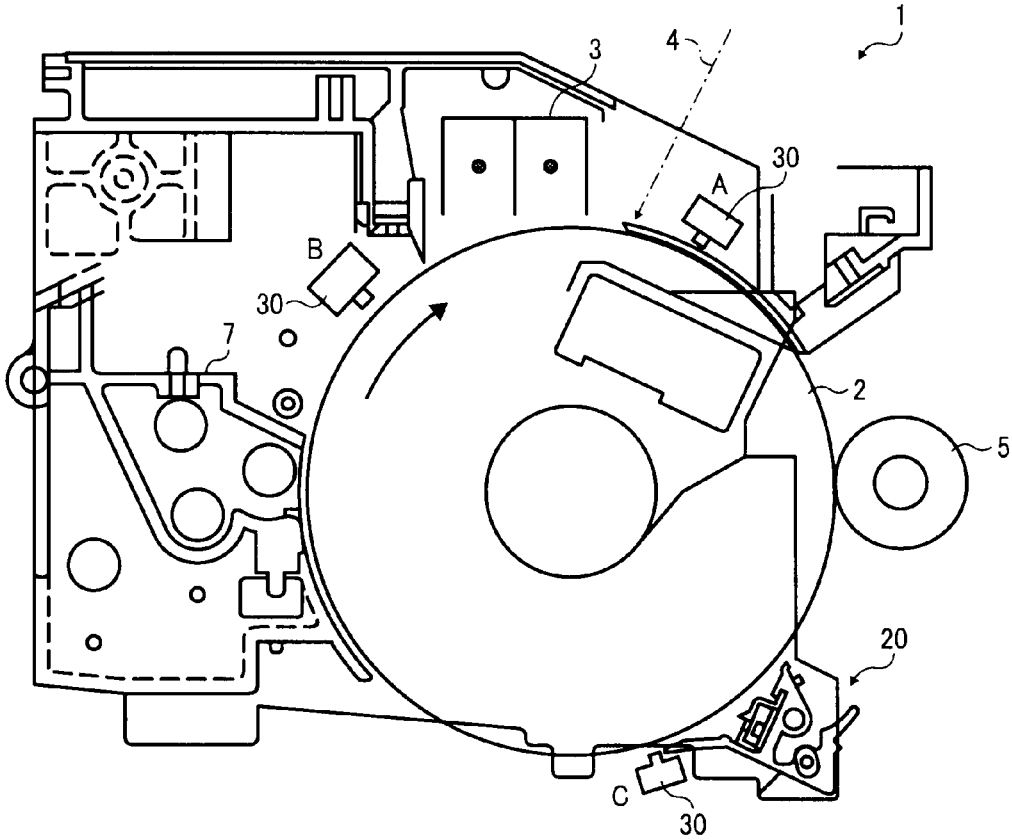
FIG. 4 is a schematic view illustrating examples of positions of a potential sensor provided in the image forming apparatus.

The image forming apparatus 1 further includes a potential sensor 30 serving as surface potential detection means to detect a potential at the surface of the photoconductor 2. The potential sensor 30 is provided at one of positions A, B, and C illustrated in FIG. 4. Specifically, the position A is positioned on a downstream side from a position to where the light 4 is directed from the irradiating device, not shown, relative to the direction of rotation of the surface of the photoconductor 2 and an upstream side from the developing device relative to the direction of rotation of the surface of the photoconductor 2. The position B is positioned on a downstream side from the cleaning device 7 relative to the direction of rotation of the surface of the photoconductor 2 and an upstream side from the charger 3 relative to the direction of rotation of the surface of the photoconductor 2. The position C is positioned on a downstream side from the PTL 20 relative to the direction of rotation of the surface of the photoconductor 2 and an upstream side from the transfer nip relative to the direction of rotation of the surface of the photoconductor 2. It is to be noted that the potential sensor 30 may be provided at a position other than the positions A to C.

The potential at the surface of the photoconductor 2 is preferably detected at the position A during process control to be described in detail later. The potential at the surface of the photoconductor 2 is preferably detected at the position C in order to control the amount of radiation from the PTL 20 and the leading edge transfer bias.

The potential sensor 30 may include either a feedback type sensor having a function to correct itself, or a non-feedback type sensor without the function to correct itself. When the non-feedback type sensor is used as the potential sensor 30, the potential sensor 30 is required to be corrected at a predetermined time. Although a time to correct the potential sensor 30 is not particularly limited, the potential sensor 30 according to illustrative embodiments is corrected during process control. The potential sensor 30 is corrected by applying a voltage of 100 V and 800 V to the photoconductor 2. Alternatively, a voltage of 200 V and 700 V may be applied to the photoconductor 2 to correct the potential sensor 30.

A description is now given of process control to determine requirements for image formation.

Figure 5:
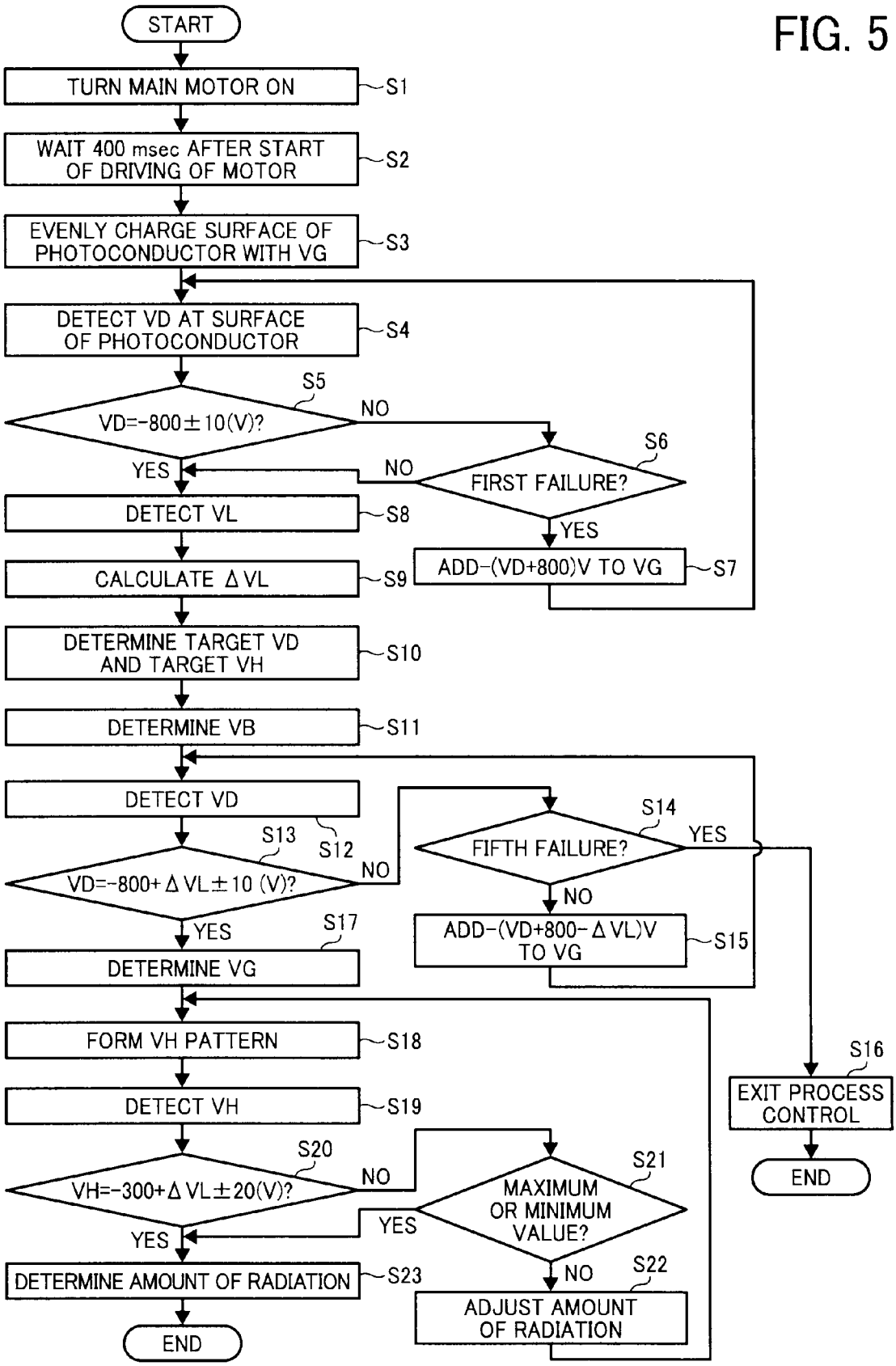
FIG. 5 is a flowchart illustrating operations of process control.

FIG. 5 is a flowchart illustrating operations of process control. In FIG. 5, VG indicates a charging bias, VD indicates a potential at an unexposed portion, VL indicates a potential at an exposed portion, VB indicates a developing bias, and VH indicates a halftone potential.

When the image forming apparatus 1 is turned on, the CPU of the control unit 100 is activated to turn on a fixing heater and the polygon mirror. At the same time, the potential sensor 30 is corrected. When a lock of the polygon motor is detected, at S1, a main motor is driven. A predetermined time (400 msec) after the start of driving of the main motor at S2, at S3 the surface of the photoconductor 2 is evenly charged with the VG of the previous value. At S4, the potential sensor 30 detects the VD on the surface of the photoconductor 2. At S5, the control unit 100 determines whether or not the VD thus detected is −800±10 V. When the control unit 100 determines that the VD is not −800±10 V (NO at S5), the process proceeds to S6 to determine whether or not this is the first failure. When the control unit 100 determines that this is the first failure (YES at S6), the process proceeds to S7 to add −(VD+800) V to the VG of the previous value and perform the processes of S4 and S5 again.

As described above, the VD on the surface of the photoconductor 2 is detected before forming a latent image pattern to adjust the VG for forming the latent image pattern. As a result, the latent image pattern can be reliably formed using the VD having the same value even when deterioration of the photoconductor 2 and environmental changes occur over time, and requirements for image formation can be accurately determined.

When the control unit 100 determines that the VD is −800±10 V (YES at S5), or determines that this is the second failure (NO at S6), the process proceeds to a determination of the VB. Specifically, at S8, the latent image pattern (VL pattern) is formed and a potential at the latent image pattern, that is, the VL, is detected by the potential sensor 30. At S9, the control unit 100 calculates a difference ΔVL between the VL detected by the potential sensor 30 and a target potential at the exposed portion, that is, −130 V. At S10, the control unit 100 determines a target VD and a target VH based on the difference ΔVL thus calculated. At S11, the control unit 100 determines the VD as a requirement for image formation. Accordingly, the developing bias VB can be reliably determined depending on the difference ΔVL caused by deterioration of the photoconductor 2 and environmental changes over time, and development can be performed using the VB of the previous value.

Thereafter, the VG corresponding to the difference ΔVL is determined. Specifically, at S12, the potential sensor 30 detects the VD, and at 13, the control unit 100 determines whether or not the VD is within the range of the target VD of (−800+ΔVL)±10 V. When the control unit 100 determines that the VD thus detected is not within the range of (−800+ΔVL)±10 V (NO at S13), the process proceeds to S14 to determine whether or not this is the fifth failure. When the control unit 100 determines that this is not the fifth failure (NO at S14), the process proceeds to S15 to add a difference of a potential value between the target VD (−800+ΔVL) and the detected VD, that is, −(VD+800−ΔVL) V, to the VG at formation of the latent image pattern (VL pattern) to perform steps S12 and S13 again. When the control unit 100 determines that this is the fifth failure (YES at S14), the process proceeds to S16 to exit process control.

By contrast, when the control unit 100 determines that the detected VD is within the range of (−800+ΔVL)±10 V (YES at S13), the process proceeds to S17 to determine that the VG of the present value is to be set.

Accordingly, the VD formed by the VG corresponds to the ΔVL, and a previously used background potential and a previously used potential difference between the VL and the VD can be used.

Thereafter, an amount of the laser diode (LD) to be emitted from the PTL 20, that is, an amount of radiation from the PTL 20, is determined.

Specifically, after the surface of the photoconductor 2 is evenly charged with the VG determined at S17, at S18, the control unit 100 forms a halftone latent image pattern (VH pattern) based on data on a previously used amount of radiation. At S19, the potential sensor 30 detects the VH pattern to detect the VH. At S20, the control unit 100 determines whether or not the VH thus detected is within a range of a target VH of (−300+ΔVL)±20 V. When the control unit 100 determines that the VH thus detected is not within the range of (−300+ΔVL)±20 V (NO at S20), the process proceeds to S21 to determine whether or not the amount of radiation is either the maximum or minimum value. When the control unit 100 determines that the amount of radiation is neither the maximum nor minimum value (NO at S21), the process proceeds to S22 to adjust the amount of radiation. Thereafter, the process returns to S18 to perform steps from S18 to S20 again.

By contrast, when the control unit 100 determines that the VH thus detected is within the range of (−300+ΔVL)±20 V (YES at S20), at S23, the amount of radiation at that time is determined to be set. When the control unit 100 determines that the amount of radiation is the maximum value (YES at S21), that value is determined as the amount of radiation to be set at S23. Similarly, when the control unit 100 determines that the amount of radiation is the minimum value (YES at S21), that value is determined as the amount of radiation to be set at S23.

Accordingly, the VH can be set based on the ΔVL, and a halftone image can be reliably reproduced. It is to be noted that, although steps from S18 to S20 are repeatedly performed until the detected VH is within the range of the target VH of (−300+ΔVL)±20 V as described above, alternatively, the control unit 100 may exit process control when the detected VH is not within the range of the target VH of (−300+ΔVL)±20 V after a predetermined number of tries.

A description is now given of a removability of the recording sheet from the surface of the photoconductor 2.

The photoconductor 2 according to illustrative embodiments includes the a-Si photoconductor, and particles of, for example, aluminum oxide, are included in the surface covering layer 12*b* to achieve a longer service life. However, even when the potential at the surface of the photoconductor 2 having a longer service life is not changed over time, it is known that the removability of the recording sheet from the surface of the photoconductor 2 decreases as the photoconductor 2 deteriorates over time compared to a fresh photoconductor 2 that has not deteriorated.

Figure 6:
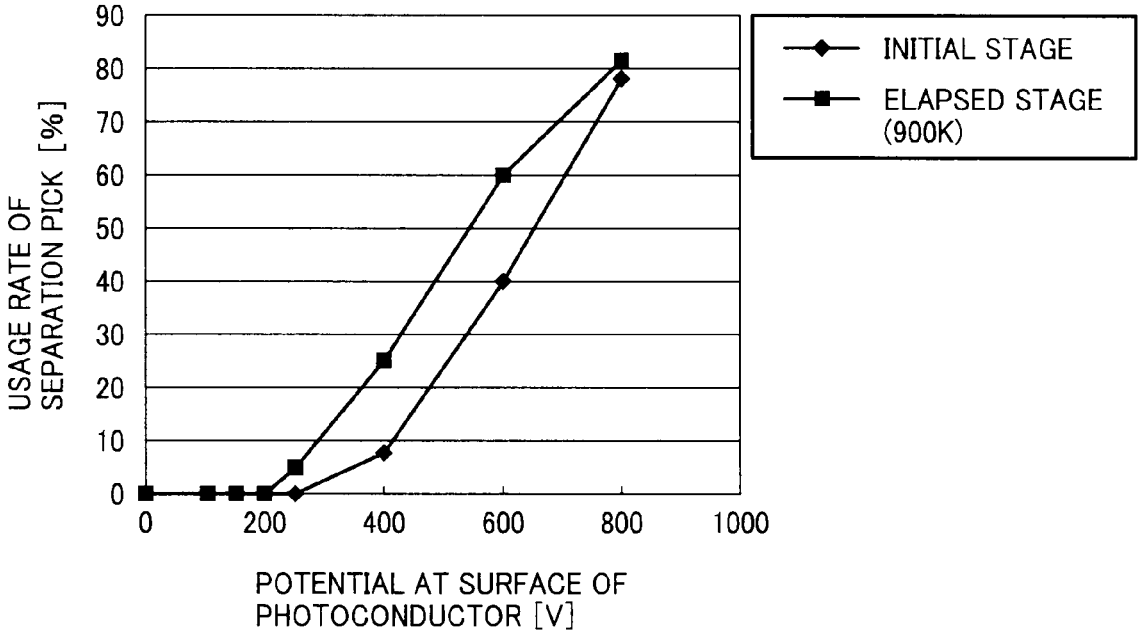
FIG. 6 is a graph illustrating a relation between a potential at a portion on a surface of a photoconductor that is to face a leading edge area of a recording medium at a transfer nip after neutralization by the PTL and a usage rate of a separation pick to remove the recording medium from the surface of the photoconductor.

FIG. 6 is a graph illustrating a comparison of a relation between a potential at a portion on the surface of the photoconductor 2 that is to face the leading edge area of the recording sheet after irradiation by the PTL 20 and a usage rate of the separation pick 18 to remove the recoding sheet from the surface of the photoconductor 2, at an initial stage of use of the photoconductor 2 and an elapsed stage after the photoconductor 2 is rotated 900,000 times to form images.

In FIG. 6, a drive voltage of the PTL 20 is set to 16 V and the leading edge transfer bias is set to 15 μA. A usage rate of the separation pick 18 to remove the recording sheet from the surface of the photoconductor 2 is obtained as follows. First, a predetermined number of the recording sheets is fed to each of the image forming apparatus 1 including the photoconductor 2 at the initial stage and that at the elapsed stage. Next, whether or not a particular mark generated when the recording sheet is removed from the surface of the photoconductor 2 using the separation pick 18 is provided on each of the fed recording sheets is visually checked to obtain a number of the recording sheets having the particular mark thereon. Thereafter, the number of the recording sheets having the particular mark thereon is divided by the total number of the fed recording sheets, and the resultant number is multiplied by 100(%) to obtain the usage rate of the separation pick 18 to remove the recording sheet from the surface of the photoconductor 2.

As shown in FIG. 6, the usage rate of the separation pick 18 is increased at the elapsed stage compared to that at the initial stage even when the potential at the surface of the photoconductor 2 is the same after irradiation by the PTL 20. In other words, the removability of the recording sheet from the surface of the photoconductor 2 decreases at the elapsed stage compared to that at the initial stage.

However, as is clear from FIG. 6, the usage rate of the separation pick 18 can be kept at 0% even at the elapsed stage when the potential at the surface of the photoconductor 2 after irradiation by the PTL 20 is kept to −200 V or less.

Therefore, one possible way to reliably remove the recording sheet from the surface of the photoconductor 2 without using the separation pick 18 is to increase the amount of radiation from the PTL 20 to neutralize the surface of the photoconductor 2 to, for example, about −50 V. However, the increase in the amount of radiation accelerates light-induced fatigue of the photoconductor 2, shortening the service life of the photoconductor 2. Further, when the toner image is formed at the portion on the surface of the photoconductor 2 that is to face the leading edge area of the recording sheet at the transfer nip, too much decrease in the potential at that portion causes blur in the image formed at the leading edge area of the recording sheet. Accordingly, it is necessary to minimize the amount of radiation from the PTL 20 as much as possible. As a result, the amount of radiation from the PTL 20, that is, the drive voltage of the PTL 20, is set such that the potential at the surface of the photoconductor 2 after irradiation by the PTL 20 is within a range between −150 V and −200 V.

However, it has been found that deterioration of the photoconductor 2 over time causes a decrease in a neutralizing effect of irradiation by the PTL 20, resulting in an increase in the potential at the exposed portion and the potential after irradiation by the PTL 20.

Figure 7:
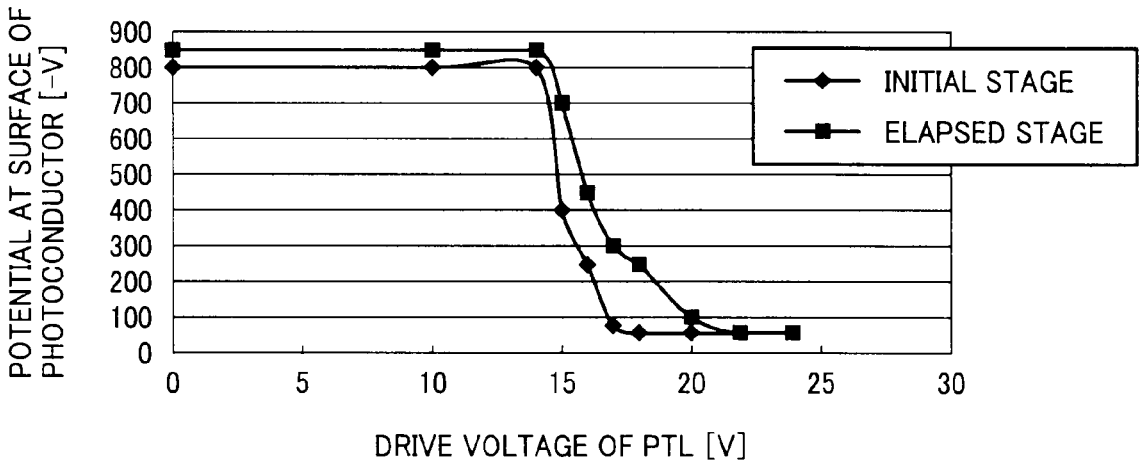
FIG. 7 is a graph illustrating a relation between a potential at the surface of the photoconductor after neutralization by the PTL and a drive voltage of the PTL.

FIG. 7 is a graph illustrating a comparison of a relation between the potential at the surface of the photoconductor 2 after irradiation by the PTL 20 and the drive voltage of the PTL 20, at the initial stage of use of the photoconductor 2 and the elapsed stage after the photoconductor 2 is rotated 900,000 times to form images.

In FIG. 7, a potential at the unexposed portion neutralized by the PTL 20 is shown. As shown in FIG. 7, the potential at the surface of the photoconductor 2 at the elapsed stage is greater than that at the initial stage even when neutralization is not performed by the PTL 20, that is, when the drive voltage of the PTL 20 is 0 V. The reason is that because process control is performed as described above, the VD is increased by ΔVL, that is, an increase in the VL due to a decrease in the neutralizing effect of irradiation caused by deterioration of the photoconductor 2 over time.

As is clear from FIG. 7, the drive voltage of the PTL 20 must be increased to keep the potential at the surface of the photoconductor 2 degraded over time at −200 V or less after neutralization by the PTL 20.

As described above, the neutralizing effect of irradiation by the PTL 20 decreases as the photoconductor 2 is degraded over time. Because the VD and the VH are also increased by the increased amount of the VL (ΔVL) by performing process control, the potential at the surface of the photoconductor 2 cannot be reduced to −200 V or less with the drive voltage of the PTL 20 used at the initial stage. Consequently, the usage rate of the separation pick 18 to remove the recording sheet from the surface of the photoconductor 2 cannot be 0% at the elapsed stage.

For example, it is assumed that the potential at the unexposed portion on the surface of the photoconductor 2 at the initial stage is about −160 V when neutralized by the PTL 20, and the potential at the exposed portion on the surface of the photoconductor 2 at the elapsed stage is increased by −50 V compared to that at the initial stage. As a result, the VD is increased by −50 V by performing process control, and the potential at the surface of the photoconductor 2 after irradiation by the PTL 20 is also increased by −50 V or more compared to that at the initial stage. Consequently, the potential at the unexposed portion on the surface of the photoconductor 2 at the elapsed stage becomes −260 V when neutralized by the PTL 20, and the recording sheet may not be removed from the surface of the photoconductor 2 without using the separation pick 18.

One possible way to prevent the above-described problem is to set the amount of radiation from the PTL 20 taking into account the decrease in the neutralizing effect of irradiation by the PTL 20 over time. However, when the amount of radiation from the PTL 20 is too large at the initial stage of use of the photoconductor 2, light-induced fatigue of the photoconductor 2 is accelerated, shortening the service life of the photoconductor 2.

It is to be noted that the photoconductor 2 having a diameter of 100 mm is used in the above-described example. However, it is confirmed that the recording sheet may not be reliably removed from the surface of the photoconductor 2 having a diameter of 80 mm providing a higher removability without using the separation pick 18 when the photoconductor 2 is degraded over time. Further, it is confirmed that the recording sheet may not be reliably removed from the photoconductor 2 having a diameter of 60 mm without using the separation pick 18 when the photoconductor 2 is degraded over time.

Therefore, in illustrative embodiments, the potential at the surface of the photoconductor 2 is detected by the potential sensor 30 to control the amount of radiation from the PTL 20 and the leading edge transfer bias applied to the transfer roller 15 based on the detection result obtained by the potential sensor 30. Accordingly, the amount of radiation from the PTL 20 is suppressed as much as possible to prevent shortening the service life of the photoconductor 2.

Figure 8:
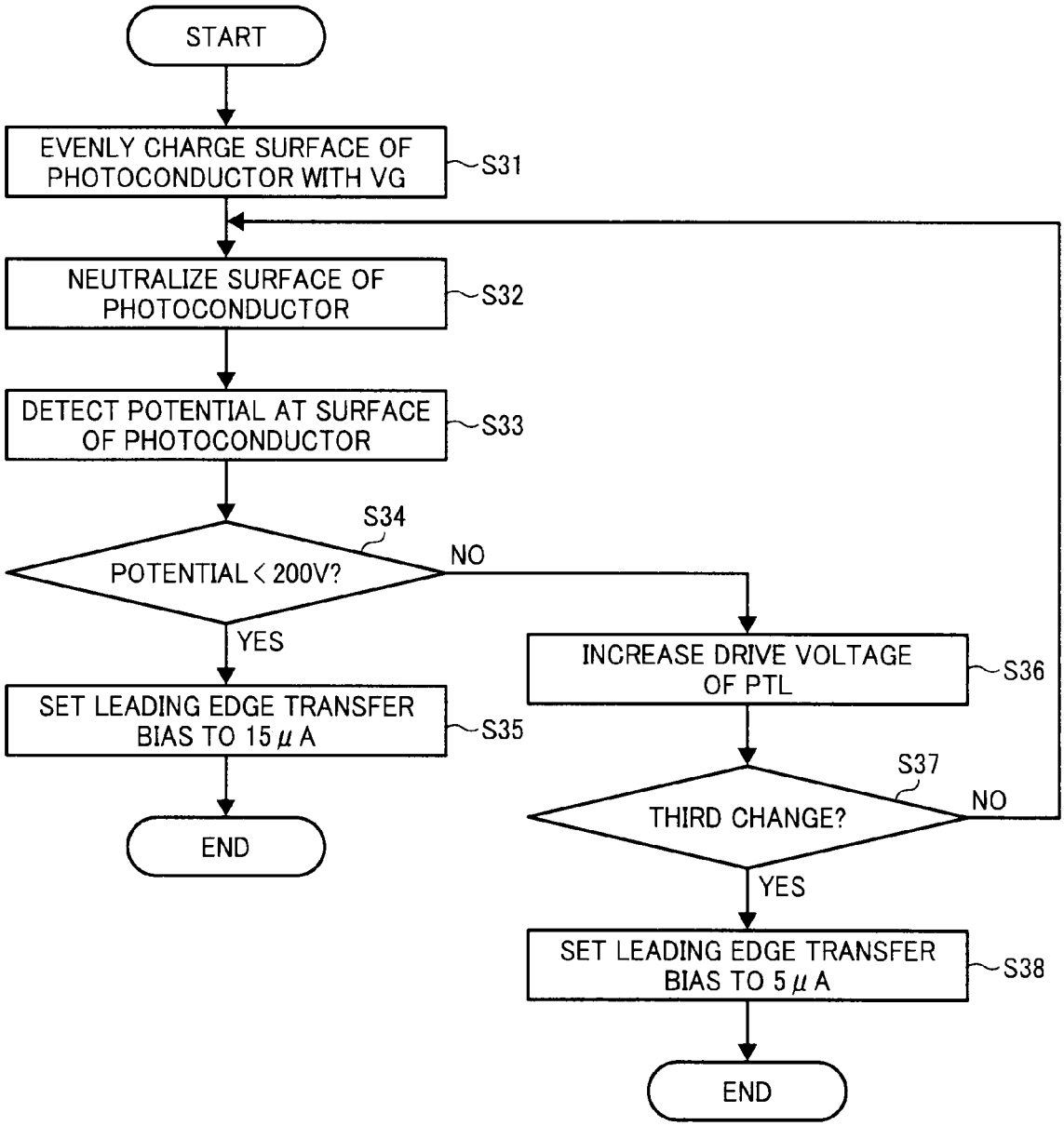
FIG. 8 is a flowchart illustrating a process to determine the drive voltage of the PTL and a leading edge transfer bias applied to a transfer roller based on a detection result obtained by the potential sensor.

FIG. 8 is a flowchart illustrating a process to determine the drive voltage of the PTL 20, that is, the amount of radiation from the PTL 20, and the leading edge transfer bias applied to the transfer roller 15 based on the detection result obtained by the potential sensor 30.

The amount of radiation from the PTL 20 and the leading edge transfer bias applied to the transfer roller 15 are determined either during process control or at each printing operation, or both during process control and at each printing operation.

At S31, the surface of the photoconductor 2 is evenly charged with the charging bias VG determined by process control. At S32, the surface of the photoconductor 2 thus charged is neutralized by irradiation by the PTL 20. At S33, the potential at the surface of the photoconductor 2 after irradiation by the PTL 20 is detected by the potential sensor 30. When the potential sensor 30 is positioned at the position C in FIG. 4, the potential at the surface of the photoconductor 2 after irradiation by the PTL 20 can be detected by the potential sensor 30 at that position. By contrast, when the potential sensor 30 is positioned at either position A or B in FIG. 4, the conveyance belt 12 is separated from the photoconductor 2 to detect the potential at the surface of the photoconductor 2 after neutralization performed by the PTL 20. Note that when the potential sensor is at positions A or B, it is not necessary to detect the potential at surface conductor in step S33 or control the amount of radiation. In a case in which the potential sensor is positioned at the position A and the surface of the photoconductor 2 is evenly charged by a charging roller contacting the surface of the photoconductor 2, the charging roller is also separated from the photoconductor 2 to detect the potential at the surface of the photoconductor 2 after neutralization performed by the PTL 20.

When the potential at the surface of the photoconductor 2 after neutralization is detected by the potential sensor 30, at S34, the control unit 100 determines whether or not the potential detected by the potential sensor 30 is less than −200V. When the control unit 100 determines that the potential detected by the potential sensor 30 is less than −200 V (YES at S34), it means that the surface of the photoconductor 2 is neutralized. Therefore, the process proceeds to S35 to determine that the drive voltage of the PTL 20 at that time is to be used, and set the leading edge transfer bias to 15 μA.

By contrast, when the control unit 100 determines that the potential detected by the potential sensor 30 is −200 V or greater (NO at S34), the process proceeds to S36 to increase the drive voltage of the PTL 20 by a predetermined amount. At S37, the control unit 100 determines whether or not the amount of the drive voltage has been changed three times. When the control unit 100 determines that the amount of the drive voltage has not been changed three times yet (NO at S37), the process is returned to S32. By contrast, when the control unit 100 determines that the amount of the drive voltage has been changed three times but the potential detected by the potential sensor 30 is still −200 V or greater (YES at S37), the process proceeds to S38 to determine that the drive voltage of the PTL 20 at that time is to be used, and set the leading edge transfer bias to 5 μA.

As described above, the potential at the surface of the photoconductor 2 after neutralization by the PTL 20 is detected by the potential sensor 30 to adjust the drive voltage of the PTL 20 and the leading edge transfer bias, so that the removability of the recording sheet from the surface of the photoconductor 2 can be achieved over time. In addition, at the initial stage of use of the photoconductor 2, the amount of radiation from the PTL 20 can be minimized to prevent light-induced fatigue of the photoconductor 2. Further, the potential at the surface of the photoconductor 2 after neutralization by the PTL 20 is detected by the potential sensor 30, so that a decrease in a neutralizing capability of the PTL 20 due to deterioration of the PTL 20 over time can be detected as well as a decrease in the neutralizing effect of irradiation due to deterioration of the photoconductor 2 over time.

Table 1 shows potentials on the surface of the photoconductor 2 after neutralization when each of a new dustproof member, a dustproof member used while the photoconductor 2 is rotated 500,000 times for forming images, and a dustproof member used while the photoconductor 2 is rotated 650,000 times for forming images is provided on the opening 20E of the cover member 20B as the dustproof member 21.

TABLE 1

| Dustproof Member | Potential at Surface of Photoconductor (−V) |
|---|---|
| New | 60 |
| 500K | 110 |
| 650K | 150 |

As shown in Table 1, as the toner is attached to the dustproof member 21 over time, the neutralizing capability of the PTL 20 decreases.

As described above, according to illustrative embodiments, a decrease in the neutralizing capability of the PTL 20 due to deterioration of the PTL 20 over time can be detected as well as a decrease in the neutralizing effect of irradiation due to deterioration of the photoconductor 2 by detecting the potential at the surface of the photoconductor 2 after neutralization by the PTL 20 using the potential sensor 30. As a result, the potential at the surface of the photoconductor 2 after neutralization can be kept at −200 V or less over time.

Alternatively, for example, the drive voltage of the PTL 20 may be decreased to reduce the amount of radiation from the PTL 20 when the potential at the surface of the photoconductor 2 after neutralization by the PTL 20 is too low. Further alternatively, a target potential at the surface of the photoconductor 2 after neutralization may be set in advance, and the drive voltage of the PTL 20 may be determined such that the potential at the surface of the photoconductor 2 after neutralization is within the range between the target potential ±10 V.

In place of detecting the potential at the surface of the photoconductor 2 after neutralization by the PTL 20, an increase in the potential at the surface of the photoconductor 2 may be obtained. Specifically, the potential at the surface of the photoconductor 2 after neutralization by the PTL 20 may be estimated based on, for example, the VL when the latent image pattern is detected by the potential sensor 30 during process control, a difference ΔVL between the VL detected by the potential sensor 30 and the target VL, the VD detected by the potential sensor 30 when determining the VG, the VH detected by the potential sensor 30 when determining the amount of radiation, and so forth, to determine the amount of radiation from the PTL 20 and the leading edge transfer voltage applied to the transfer roller 15. In such a case, it is preferable to estimate the potential at the surface of the photoconductor 2 after irradiation by the PTL 20 taking into account the decrease in the neutralizing capability of the PTL 20 caused by dust attached to the dustproof member 21 shown in Table 1.

Alternatively, the potential at the surface of the photoconductor 2 may be detected by the potential sensor 30 after the surface of the photoconductor 2 is neutralized by the PTL 20 and the leading edge transfer bias is applied to the transfer roller 15. The recording sheet is attracted to the surface of the photoconductor 2 due to a higher potential at the surface of the photoconductor 2 after passing through the transfer nip. Accordingly, the surface of the photoconductor 2 can be detected by the potential sensor 30 after the surface of the photoconductor 2 is neutralized and the leading edge transfer bias is applied to the transfer roller 15 at the transfer nip to detect the potential at the surface of the photoconductor 2 after passing though the transfer nip, so that the amount of radiation from the PTL 20 can be more accurately adjusted.

In the above-described case, when the potential at the surface of the photoconductor 2 after application of the leading edge transfer bias to the transfer roller 15 is higher than a predetermined value, the drive voltage of the PTL 20 may be increased to increase the amount of radiation from the PTL 20, so that the potential at the surface of the photoconductor 2 after application of the leading edge transfer bias is decreased. It is to be noted that either the potential at the exposed portion or the unexposed portion on the surface of the photoconductor 2 after application of the leading edge transfer bias may be detected by the potential sensor 30.

Alternatively, only the leading edge transfer bias may be changed based on the potential at the surface of the photoconductor 2 after neutralization by the PTL 20 without changing the drive voltage of the PTL 20. In such a case, a look-up table (LUT) in which the potential at the surface of the photoconductor 2 after neutralization by the PTL 20 and the leading edge transfer bias are associated with each other is provided to determine the leading edge transfer bias based on the detection result obtained by the potential sensor 30 and the LUT.

A description is now given of a verification experiment conducted to verify the effects of the present disclosure.

Table 2 below shows a usage rate of the separation pick 18 to remove the recording sheet of each type from the surface of the photoconductor 2 at each of the initial stage of use of the photoconductor 2 and the elapsed stage after the photoconductor 2 has been rotated 900,000 times for forming images. In Table 2, the drive voltage of the PTL 20 was not changed based on the detection result obtained by the potential sensor 30, and the drive voltage of the PTL 20 was set to 17 V. The usage rate of the separation pick 18 to remove the recording sheet from the surface of the photoconductor 2 was obtained in a way similar to that described above.

Table 3 below shows a usage rate of the separation pick 18 to remove the recording sheet of each type from the surface of the photoconductor 2 at each of the initial stage and the elapsed stage when the drive voltage of the PTL 20 was changed based on the detection result obtained by the potential sensor 30 as illustrated in FIG. 8. In Table 3, the drive voltage of the PTL 20 was set to 17 V at the initial stage, and was changed to 20 V at the elapsed stage.

In the verification experiment, the recording sheet was set in a direction in which the particular marks are more easily generated on the recording sheet, and types of the recording sheet on which the particular marks are more easily generated were used. Further, the recording sheet in which temperature and humidity are not adjusted, the recording sheet left under an N/N environment (23° C./50% RH) for eight hours, and the recording sheet left under an H/H environment (27° C./90% RH) for eight hours were used, and overall results are shown in Tables 2 and 3.

TABLE 2

| PTL 20: ON | Drive Voltage of PTL 20: 17 V Usage Rate of Separation Pick | |
|---|---|---|
| Types of Paper | Initial Stage | Elapsed Stage |
| OA-Paper | 0% | 3% |
| EW-100 | 0% | 1% |
| α-Eco Paper | 0% | 5% |
| Paper Source S | 0% | 3% |
| EN-100 | 0% | 2% |

(Linear velocity: 362 mm/sec)

TABLE 3

| PTL 20: ON | Drive Voltage of PTL 20: 20 V Usage Rate of Separation Pick | |
|---|---|---|
| Types of Paper | Initial Stage | Elapsed Stage |
| OA-Paper | 0% | 0% |
| EW-100 | 0% | 0% |
| α-Eco Paper | 0% | 0% |
| Paper Source S | 0% | 0% |
| EN-100 | 0% | 0% |

(Linear velocity: 362 mm/sec)

As is clear from Table 2, a part of all types of the recording sheet was not removed from the surface of the photoconductor 2 without using the separation pick 18 at the elapsed stage when the drive voltage of the PTL 20 was not changed over time. By contrast, as shown in Table 3, because the drive voltage of the PTL 20 was changed based on the detection result obtained by the potential sensor 30 such that the potential at the surface of the photoconductor 2 after neutralization was kept at 200 V or less over time, all types of the recording sheet were removed from the surface of the photoconductor 2 at the elapsed stage without using the separation pick 18.

Further, a humidity control experiment was performed using the image forming apparatus 1 including the photoconductor 2 at the elapsed stage after being rotated 900,000 times for forming images. In the humidity control experiment, about 3,000 sheets of paper were fed to the image forming apparatus 1 under the H/H environment (27° C./90% RH) and the drive voltage of the PTL 20 was changed based on the detection result obtained by the potential sensor 30 as illustrated in FIG. 8. As a result, all types of paper were removed from the surface of the photoconductor 2 without using the separation pick 18. It should be noted that in the humidity control experiment, moisture-containing paper left under the H/H environment was used.

In illustrative embodiments, a portion on the surface of the photoconductor 2 corresponding to the leading edge area of the recording sheet is neutralized by the PTL 20 and the transfer bias applied to the leading edge area of the recording sheet is reduced in order to enhance the removability of the recording sheet from the surface of the photoconductor 2. Depending on a configuration of the image forming apparatus 1, either one of neutralization of the surface of the photoconductor 2 or reduction of the transfer bias may be performed. In the image forming apparatus 1 in which the removability of the leading edge of the recording sheet from the surface of the photoconductor 2 is enhanced by reducing the transfer bias without using the PTL 20, the potential at, for example, the exposed portion on the surface of the photoconductor 2 is detected. When the potential at the exposed portion is increased due to deterioration of the photoconductor 2 over time, the leading edge transfer bias is reduced. As a result, an amount of charge at the leading edge area of the recording sheet is further reduced, so that the leading edge of the recording sheet can be preferably removed from the surface of the photoconductor 2 even when the potential at the surface of the photoconductor 2 is increased.

Figure 9:
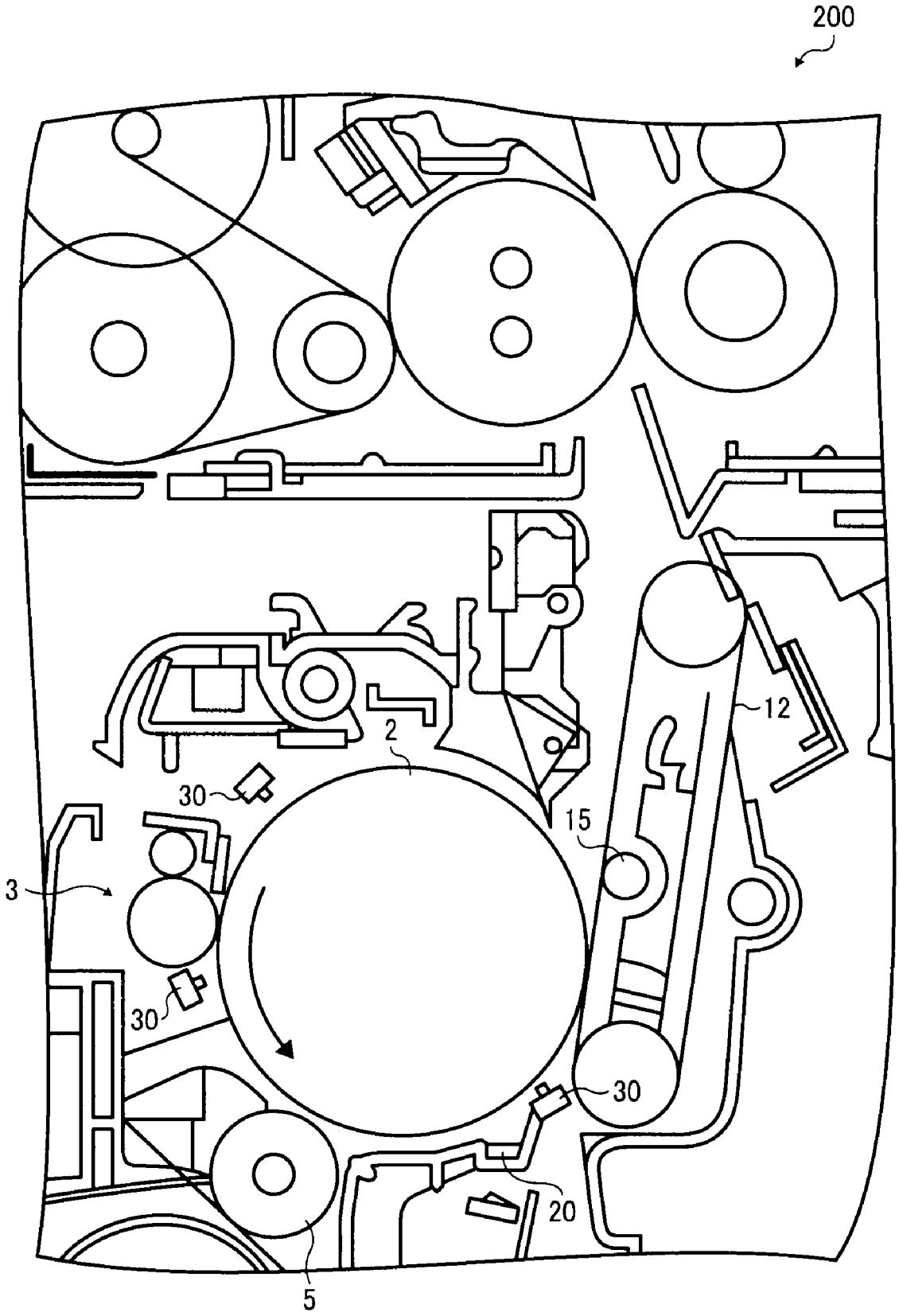
FIG. 9 is a schematic view illustrating another example of a configuration of an image forming apparatus according to illustrative embodiments.
Figure 10:
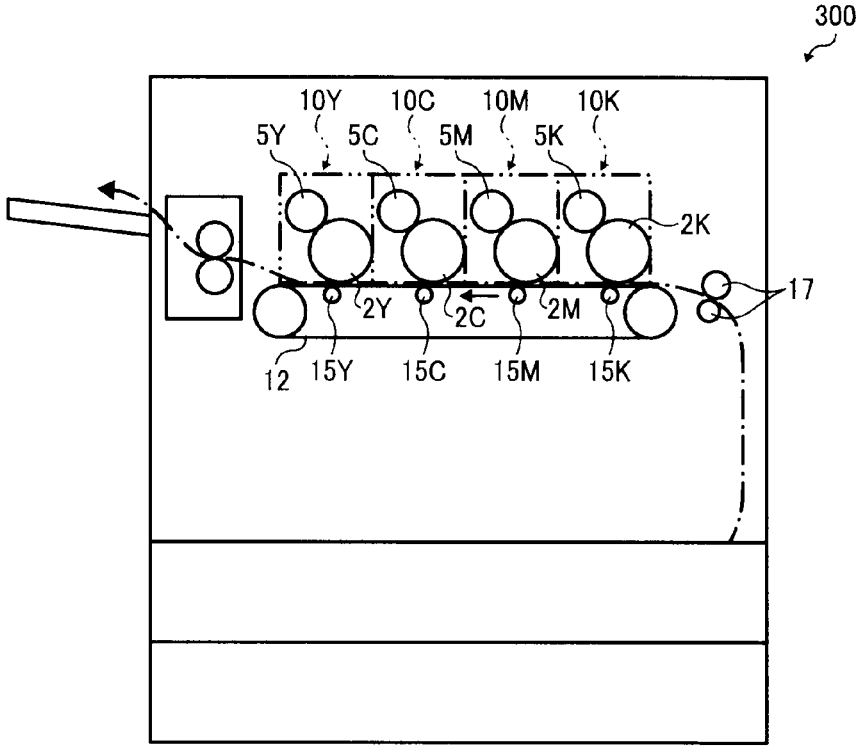
FIG. 10 is a schematic view illustrating yet another example of a configuration of an image forming apparatus according to illustrative embodiments.

Illustrative embodiments are also applicable to an image forming apparatus 200 illustrated in FIG. 9 in which the recording sheet is vertically conveyed, and a tandem type image forming apparatus 300 using a direct transfer system as illustrated in FIG. 10. In the tandem type image forming apparatus 300 illustrated in FIG. 10, the PTL 20 and the potential sensor 30 are provided in each of image forming units 1Y, 1C, 1M, and 1K. Accordingly, the removability of the recording sheet from each of photoconductors 2Y, 2C, 2M, and 2K can be maintained over time.

Figure 11:
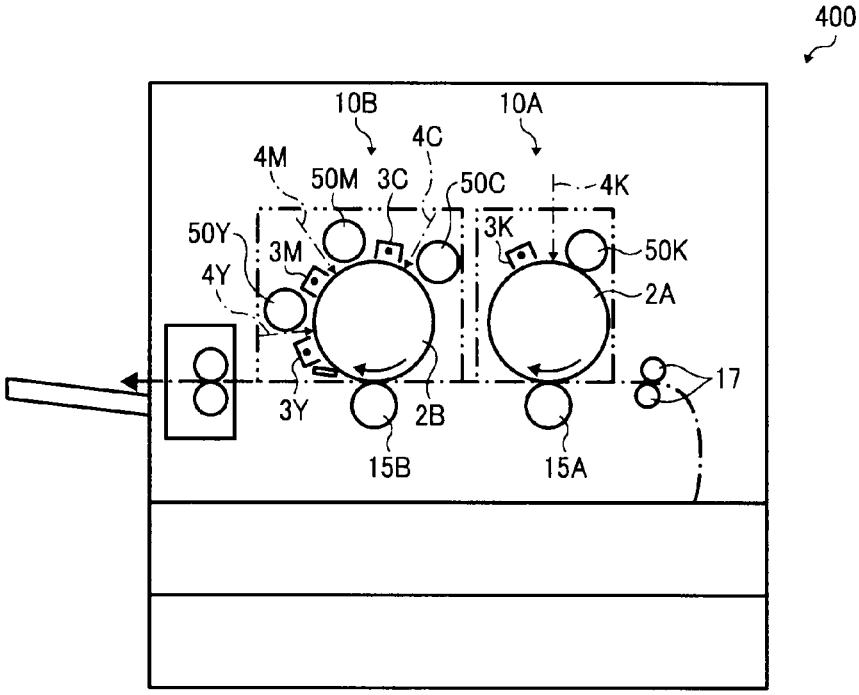
FIG. 11 is a schematic view illustrating yet another example of a configuration of an image forming apparatus according to illustrative embodiments.

Further, illustrative embodiments are also applicable to a full-color image forming apparatus 400 illustrated in FIG. 11. The full-color image forming apparatus 400 includes a first image forming unit 10A that forms black toner images, and a second image forming unit 10B that forms each of yellow, magenta, and cyan images. In the second image forming unit 10B, chargers 3Y, 3M, and 3C and developing devices 50Y, 50M, and 50C are provided around a photoconductor 2B to form yellow, magenta, and cyan images. Illustrative embodiments are also applicable to the first and second image forming units 10A and 10B so that the removability of the recording sheet from each of a surface of a photoconductor 2A and a surface of the photoconductor 2B can be maintained over time.

Further, in the second image forming unit 10B, light 4C for forming the cyan images and light 4M for forming the magenta images, each of which is emitted to a downstream side relative to a direction of rotation of the surface of the photoconductor 2B, may be used as the pre-transfer neutralizing means for neutralizing a portion on the surface of the photoconductor 2B corresponding to the leading edge area of the recording sheet.

As described above, illustrative embodiments may be applicable to the negative-positive process to form images. In the negative-positive process, a potential at a portion on the evenly charged surface of the photoconductor 2 where an image is to be formed is reduced by the irradiating device to form an electrostatic latent image, and toner charged to a polarity identical to the polarity of the charged surface of the photoconductor 2 is applied to the electrostatic latent image by the developing device to form a toner image. Alternatively, illustrative embodiments may be applicable to the positive-positive process to form images. In the positive-positive process, a potential at a portion on the evenly charged surface of the photoconductor 2 where an image is not to be formed is reduced by the irradiating device to form an electrostatic latent image, and toner charged to a polarity opposite the polarity of the charged surface of the photoconductor 2 is applied to the electrostatic latent image by the developing device to form a toner image.

In the positive-positive process, a portion on the surface of the photoconductor 2 where the image is to be formed becomes an unexposed portion, and a portion on the surface of the photoconductor 2 where the image is not to be formed becomes an exposed portion. When the image is not formed at a portion on the surface of the photoconductor 2 corresponding to the leading edge area of the recording sheet, the removability of the recording sheet from the surface of the photoconductor 2 is maintained because the potential at that portion is neutralized by the irradiating device. However, when the image is to be formed at the leading edge area of the recording sheet, the portion on the surface of the photoconductor 2 corresponding to the leading edge area of the recording sheet becomes the unexposed portion. Therefore, the portion on the surface of the photoconductor 2 corresponding to the leading edge area of the recording sheet needs to be neutralized by the PTL 20. Further, in the positive-positive process, when the potential at the surface of the photoconductor 2 after irradiation is increased due to deterioration of the photoconductor 2 over time, the potential at the unexposed portion on the surface of the photoconductor 2 is also increased by performing process control. Consequently, the removability of the recording sheet from the surface of the photoconductor 2 is degraded when the image is formed at the leading edge area of the recording sheet. Application of illustrative embodiments to the positive-positive process can solve the above-described problems and reliably provide the removability of the recording sheet from the surface of the photoconductor 2 over time even when the image is formed at the leading edge area of the recording sheet.

According to illustrative embodiments, the potential sensor 30 that detects the potential at the surface of the photoconductor 2 is provided, and the control unit 100 controls the amount of radiation from the PTL 20 based on the detection result obtained by the potential sensor 30. Accordingly, the potential at the surface of the photoconductor 2 after neutralization by the PTL 20 can be detected by the potential sensor 30. Specifically, when the surface of the photoconductor 2 tends not to be neutralized by irradiation by the PTL 20 due to deterioration of the photoconductor 2 over time or deterioration of the neutralizing capability of the PTL 20 over time, an increase in the potential at the surface of the photoconductor 2 after neutralization can be detected. In order to keep the potential at the surface of the photoconductor 2 such that the recording sheet can be removed from the surface of the photoconductor 2 without using the separation pick 18, the amount of radiation from the PTL 20 is adjusted based on the detection result obtained by the potential sensor 30. As a result, the removability of the recording sheet from the surface of the photoconductor 2 without using the separation pick 18 can be maintained over time.

The control unit 100 controls the transfer bias such that the leading edge transfer bias is applied to the transfer roller 15 before the leading edge of the recording sheet enters the transfer nip, and then the normal transfer bias higher than the leading edge transfer bias is applied to the transfer roller 15 before a rear edge of the leading edge area of the recording sheet enters the transfer nip. Accordingly, an amount of charge at the leading edge area of the recording sheet is reduced, so that a force that electrostatically attracts the leading edge area of the recording sheet to the surface of the photoconductor 2 is further reduced. As a result, the recording sheet can be reliably removed from the surface of the photoconductor 2 without using the separation pick 18.

The control unit 100 controls the leading edge transfer bias based on the detection result obtained by the potential sensor 30. Specifically, when the potential at the surface of the photoconductor 2 after neutralization by the PTL 20 is too high, the leading edge transfer bias applied to the transfer roller 15 is decreased to reduce the amount of charge at the leading edge area of the recording sheet. As a result, the recording sheet can be more reliably removed from the surface of the photoconductor 2 without using the separation pick 18.

The potential sensor 30 detects the potential at the surface of the photoconductor 2 after neutralization by the PTL 20 and before transfer of the toner image onto the recording sheet. Accordingly, a change in the potential at the surface of the photoconductor 2 after neutralization due to a decrease in the neutralizing capability of the PTL 20 over time can be detected as well as a change in the potential at the surface of the photoconductor 2 after neutralization due to deterioration of the photoconductor 2 over time. As a result, the amount of radiation from the PTL 20 and the leading edge transfer bias can be accurately controlled.

The control unit 100 may control the leading edge transfer bias based on the potential at the unexposed portion on the surface of the photoconductor 2 detected by the potential sensor 30. When the potential at the unexposed portion is increased, the leading edge of the recording sheet tends to be attracted to the surface of the photoconductor 2. Accordingly, in such a case, the leading edge transfer bias is decreased to further reduce the amount of charge at the leading edge area of the recording sheet.

The control unit 100 corrects a target potential at the unexposed portion on the surface of the photoconductor 2 based on the potential at the exposed portion on the surface of the photoconductor 2 detected by the potential sensor 30. Thereafter, the control unit 100 determines the charging bias from the charger 3 such that the potential at the unexposed portion becomes the target potential thus corrected. As a result, the potential at the unexposed portion on the surface of the photoconductor 2 charged with the charging bias thus determined becomes the target potential corrected based on the potential at the exposed portion on the surface of the photoconductor 2 detected by the potential sensor 30. The potential at the unexposed portion is changed when the potential at the exposed portion is increased due to deterioration of the photoconductor 2 over time. Therefore, the potential at the unexposed portion on the surface of the photoconductor 2 is detected by the potential sensor 30 to estimate the amount of radiation when the photoconductor 2 is degraded over time. As a result, the potential at the surface of the photoconductor 2 after neutralization when the photoconductor 2 is degraded over time can be estimated. Therefore, the amount of radiation from the PTL 20 may be controlled based on the potential at the unexposed portion. The potential at the surface of the photoconductor 2 after neutralization can be estimated based on the potential at the unexposed portion detected by the potential sensor 30. As a result, the amount of radiation from the PTL 20 can be adjusted such that the potential at the surface of the photoconductor 2 after neutralization can provide the removability of the recording sheet from the surface of the photoconductor 2 without using the separation pick 18 even when the photoconductor 2 is degraded over time.

Further, a change in the potential at the unexposed portion on the surface of the photoconductor 2 can be estimated by detecting the potential at the exposed portion on the surface of the photoconductor 2 using the potential sensor 30. Accordingly, the leading edge transfer bias may be controlled based on the potential at the exposed portion. Because the potential at the unexposed portion can be estimated from the potential at the exposed portion detected by the potential sensor 30, the leading edge transfer bias can be adjusted such that the amount of charge at the leading edge area of the recording sheet prevents the recording sheet from being attracted to the surface of the photoconductor 2.

The control unit 100 may control the amount of radiation from the PTL 20 based on the potential at the exposed portion on the surface of the photoconductor 2 detected by the potential sensor 30. Accordingly, the potential at the surface of the photoconductor 2 after irradiation by the PTL 20 can be obtained, and the amount of radiation from the PTL 20 can be adjusted such that the potential at the surface of the photoconductor 2 after neutralization can reliably provide the removability of the recording sheet from the surface of the photoconductor 2 without using the separation pick 18.

The potential at the exposed portion detected by the potential sensor 30 may be the potential at the exposed portion corresponding to a solid image or a halftone image.

The potential sensor 30 may detect a potential at the surface of the photoconductor 2 not yet evenly charged after transfer. When the potential at the surface of the photoconductor 2 after transfer is too high, it means that the leading edge of the recording sheet tends to be attracted to the surface of the photoconductor 2. Therefore, in such a case, the leading edge transfer bias is reduced or the amount of radiation from the PTL 20 is increased to prevent the leading edge of the recording sheet from being attracted to the surface of the photoconductor 2.

Elements and/or features of different illustrative embodiments may be combined with each other and/or substituted for each other within the scope of this disclosure and appended claims.

Illustrative embodiments being thus described, it will be apparent that the same may be varied in many ways. Such exemplary variations are not to be regarded as a departure from the scope of the present invention, and all such modifications as would be obvious to one skilled in the art are intended to be included within the scope of the following claims.

The number of constituent elements and their locations, shapes, and so forth are not limited to any of the structure for performing the methodology illustrated in the drawings.

What is claimed is:

1. An image forming apparatus, comprising:

a latent image bearing member, rotated to bear an electrostatic latent image on a surface thereof;

a charger to evenly charge the surface of the latent image bearing member;

an electrostatic latent image forming device to form an electrostatic latent image on the surface of the latent image bearing member;

a developing device to develop the electrostatic latent image formed on the surface of the latent image bearing member into a toner image using toner;

a transfer bias application device to apply a transfer bias to an image transfer area where the latent image bearing member faces a recording medium onto which the toner image is to be transferred from the surface of the latent image bearing member;

a pre-transfer neutralizing device to reduce an electric potential at a portion on the surface of the latent image bearing member that is to face a leading edge area of the recording medium at the image transfer area after development performed by the developing device;

a surface electric potential detector to detect an electric potential at the surface of the latent image bearing member; and a radiation amount control device to control an amount of radiation from the pre-transfer neutralizing device based on a detection result obtained by the surface electric potential detector, wherein the radiation amount control device controls an amount of radiation from the pre-transfer neutralizing device based on an electric potential at an exposed portion on the surface of the latent image bearing member detected by the surface electric potential detector, and wherein the electric potential at the exposed portion on the surface of the latent image bearing member detected by the surface electric potential detector corresponds to a solid image.

2. The image forming apparatus according to claim 1, wherein:

the electrostatic latent image forming device reduces an electric potential at a portion on the surface of the latent image bearing member where an image is to be formed to form the electrostatic latent image; and the developing device causes the toner charged to a polarity identical to a polarity of the charged surface of the latent image bearing member to attach to the electrostatic latent image formed on the surface of the latent image bearing member to form the toner image.

3. The image forming apparatus according to claim 1, wherein the surface electric potential detector detects the electric potential at the surface of the latent image bearing member before transfer after neutralization is performed by the pre-transfer neutralizing device.

4. An image forming apparatus, comprising:

a latent image bearing member, rotated to bear an electrostatic latent image on a surface thereof;

a charger to evenly charge the surface of the latent image bearing member;

an electrostatic latent image forming device to form an electrostatic latent image on the surface of the latent image bearing member;

a developing device to develop the electrostatic latent image formed on the surface of the latent image bearing member into a toner image using toner;

a transfer bias application device to apply a transfer bias to an image transfer area where the latent image bearing member faces a recording medium onto which the toner image is to be transferred from the surface of the latent image bearing member;

a pre-transfer neutralizing device to reduce an electric potential at a portion on the surface of the latent image bearing member that is to face a leading edge area of the recording medium at the image transfer area after development performed by the developing device;

a surface electric potential detector to detect an electric potential at the surface of the latent image bearing member;

a radiation amount control device to control an amount of radiation from the pre-transfer neutralizing device based on a detection result obtained by the surface electric potential detector; and an image forming requirement determination unit to correct a target electric potential at an unexposed portion on the surface of the latent image bearing member based on an electric potential at a latent image pattern formed on the surface of the latent image bearing member to determine a charging bias applied from the charger such that an electric potential at the unexposed portion becomes the corrected target electric potential, wherein the radiation amount control device controls an amount of radiation from the pre-transfer neutralizing device based on the electric potential at the unexposed portion on the surface of the latent image bearing member detected by the surface electric potential detector.

5. An image forming apparatus, comprising:

a latent image bearing member, rotated to bear an electrostatic latent image on a surface thereof;

a charger to evenly charge the surface of the latent image bearing member;

an electrostatic latent image forming device to form an electrostatic latent image on the surface of the latent image bearing member;

a developing device to develop the electrostatic latent image formed on the surface of the latent image bearing member into a toner image using toner;

a transfer bias application device to apply a transfer bias to an image transfer area where the latent image bearing member faces a recording medium onto which the toner image is to be transferred from the surface of the latent image bearing member;

a pre-transfer neutralizing device to reduce an electric potential at a portion on the surface of the latent image bearing member that is to face a leading edge area of the recording medium at the image transfer area after development performed by the developing device;

a surface electric potential detector to detect an electric potential at the surface of the latent image bearing member; and a radiation amount control device to control an amount of radiation from the pre-transfer neutralizing device based on a detection result obtained by the surface electric potential detector, wherein the radiation amount control device controls an amount of radiation from the pre-transfer neutralizing device based on an electric potential at an exposed portion on the surface of the latent image bearing member detected by the surface electric potential detector, and wherein the electric potential at the exposed portion on the surface of the latent image bearing member detected by the surface electric potential detector corresponds to a halftone image.

6. An image forming apparatus, comprising:

a latent image bearing member, rotated to bear an electrostatic latent image on a surface thereof;

a charger to evenly charge the surface of the latent image bearing member;

an electrostatic latent image forming device to form an electrostatic latent image on the surface of the latent image bearing member;

a developing device to develop the electrostatic latent image formed on the surface of the latent image bearing member into a toner image using toner;

a transfer bias application device to apply a transfer bias to an image transfer area where the latent image bearing member faces a recording medium onto which the toner image is to be transferred from the surface of the latent image bearing member;

a pre-transfer neutralizing device to reduce an electric potential at a portion on the surface of the latent image bearing member that is to face a leading edge area of the recording medium at the image transfer area after development performed by the developing device;

a surface electric potential detector to detect an electric potential at the surface of the latent image bearing member; and a radiation amount control device to control an amount of radiation from the pre-transfer neutralizing device based on a detection result obtained by the surface electric potential detector, wherein the surface electric potential detector detects the electric potential at the surface of the latent image bearing member after transfer before the charger evenly charges the surface of the latent image bearing member.

7. The image forming apparatus according to claim 6, further comprising:

a conveyance belt to convey the recording medium, the conveyance belt wound around a plurality of rollers and contacting the latent image bearing member at a position where the conveyance belt and the latent image bearing member face each other to form a transfer nip, wherein the transfer bias application device contacts a back surface of the conveyance belt; and wherein the conveyance belt is separated from the latent image bearing member so that the surface electric potential detector detects the electric potential at the surface of the latent image bearing member after neutralization performed by the pre-transfer neutralizing device.

* * * * *